US011661299B2

(12) United States Patent
Kakuta et al.

(10) Patent No.: US 11,661,299 B2
(45) Date of Patent: May 30, 2023

(54) CONVEYANCE GUIDE UNIT

(71) Applicant: KYOCERA Document Solutions Inc., Osaka (JP)

(72) Inventors: Masayuki Kakuta, Osaka (JP); Risa Hibino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 134 days.

(21) Appl. No.: 17/328,499

(22) Filed: May 24, 2021

(65) Prior Publication Data

US 2021/0362974 A1 Nov. 25, 2021

(30) Foreign Application Priority Data

May 25, 2020 (JP) ..... JP2020-090844

(51) Int. Cl.
*B65H 29/52* (2006.01)

(52) U.S. Cl.
CPC ..... *B65H 29/52* (2013.01); *B65H 2402/44* (2013.01); *B65H 2402/60* (2013.01); *B65H 2801/06* (2013.01); *B65H 2801/27* (2013.01)

(58) Field of Classification Search
CPC . B65H 5/36; B65H 5/38; B65H 29/52; B65H 2402/10; B65H 2402/40; B65H 2402/44; B65H 2402/60; B65H 2405/11151; B65H 2801/24; B65H 2801/27
See application file for complete search history.

(56) References Cited

U.S. PATENT DOCUMENTS

2011/0215517 A1* 9/2011 Mizutani ..... B65H 29/52 271/234
2017/0036877 A1 2/2017 Izumichi
2017/0057776 A1* 3/2017 Nobe ..... B65H 45/18
2021/0309475 A1* 10/2021 Kakuta ..... B65H 5/36

FOREIGN PATENT DOCUMENTS

JP 2017032988 A 2/2017

* cited by examiner

*Primary Examiner* — Prasad V Gokhale
(74) *Attorney, Agent, or Firm* — Alleman Hall Creasman & Tuttle LLP

(57) ABSTRACT

The conveyance guide unit is provided with a guide member, a supporting frame, and an external cover. The guide member guides a sheet, which is discharged from a sheet discharge port of the image forming apparatus or from a sheet discharge port of a relay conveyance device installed in the image forming apparatus, to the sheet carrying-in port of a post-processing device. The supporting frame supports the guide member. The external cover is fixed to the supporting frame; the external cover covers an upper part of the guide member and side parts of the guide member in a traverse direction of a sheet conveyance path, which is perpendicular to a sheet conveyance direction. The external cover has an upper surface serving as an extension part of a discharge tray part of the post-processing device, the extension part being extended downstream, in a sheet discharge direction.

7 Claims, 30 Drawing Sheets

CONVEYANCE GUIDE UNIT

INCORPORATION BY REFERENCE

This application is based upon and claims the benefit of priority from the corresponding Japanese Patent Application No. 2020-090844 filed on May 25, 2020 the entire contents of which are incorporated herein by reference.

BACKGROUND

The present disclosure relates to a conveyance guide unit that guides sheets from an image forming apparatus to a post-processing device.

There is known a post-processing device that performs post-processing on sheets discharged from an image forming apparatus, such as punching, stapling, and folding. Such a post-processing device is provided with a cabinet that contains a post-processing mechanism that executes post-processing.

The cabinet has a sheet carrying-in port; the sheet carrying-in port communicates with a sheet discharge port of an image forming apparatus by way of a relay conveyance device. The relay conveyance device is installed in an internal paper discharge space of the image forming apparatus. The post-processing device supplies, one by one, printed sheets coming through the sheet carrying-in port of the cabinet to the post-processing mechanism.

The post-processing mechanism executes post-processing on the sheets and discharges the finished sheets onto a discharge tray through a sheet discharge port. The sheet discharge port is formed in a side surface of the cabinet, which is opposite to a side surface adjacent to the image forming apparatus.

The discharge tray is attached to a position adjacent to a lower end edge of the sheet discharge port. The sheets discharged from the sheet discharge port are accumulated on the discharge tray. The printed sheets discharged from the image forming apparatus can be directly supplied to the post-processing device, not by way of the relay conveyance device.

SUMMARY

A conveyance guide unit according to one aspect of the present disclosure is disposed in a space between an image forming apparatus that forms images on sheets and a post-processing device that is attached to a side surface of the image forming apparatus in a detachable manner and performs post-processing on the sheets subjected to image forming. The post-processing device has a cabinet, a sheet carrying-in port, a discharge housing part, a discharge tray part, and a sheet discharge port. The cabinet contains a post-processing mechanism. The sheet carrying-in port is formed in a side surface of the cabinet, which is adjacent to the image forming apparatus. The discharge housing part protrudes upward from a top surface of the cabinet and contains a sheet discharge mechanism. The discharge tray part is formed toward the image forming apparatus from the discharge housing part protruding from the top surface of the cabinet. The sheet discharge port is formed in a side surface of the discharge housing part, which is adjacent to the image forming apparatus. The post-processing device is configured to perform post-processing on sheets coming through the sheet carrying-in port by the post-processing mechanism, then discharge the sheets through the sheet discharge port toward the image forming apparatus by the sheet discharge mechanism. The conveyance guide unit is provided with a guide member, a supporting frame, and an external cover. The guide member guides a sheet, which is discharged from the sheet discharge port of the image forming apparatus or a sheet discharge port of the relay conveyance device, to the sheet carrying-in port of the post-processing device. The supporting frame supports the guide member. The external cover is fixed to the supporting frame; the external cover covers an upper part of the guide member and side parts of the guide member in a traverse direction of a sheet conveyance path, which is perpendicular to a sheet conveyance direction. The external cover has an upper surface serving as an extension part of the discharge tray part of the post-processing device, which is extended downstream, in a sheet discharge direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, one or more embodiments of the present disclosure will be described in detail with reference to the drawings. The present disclosure should not be limited to any embodiment described below.

Embodiment

Figure 1:
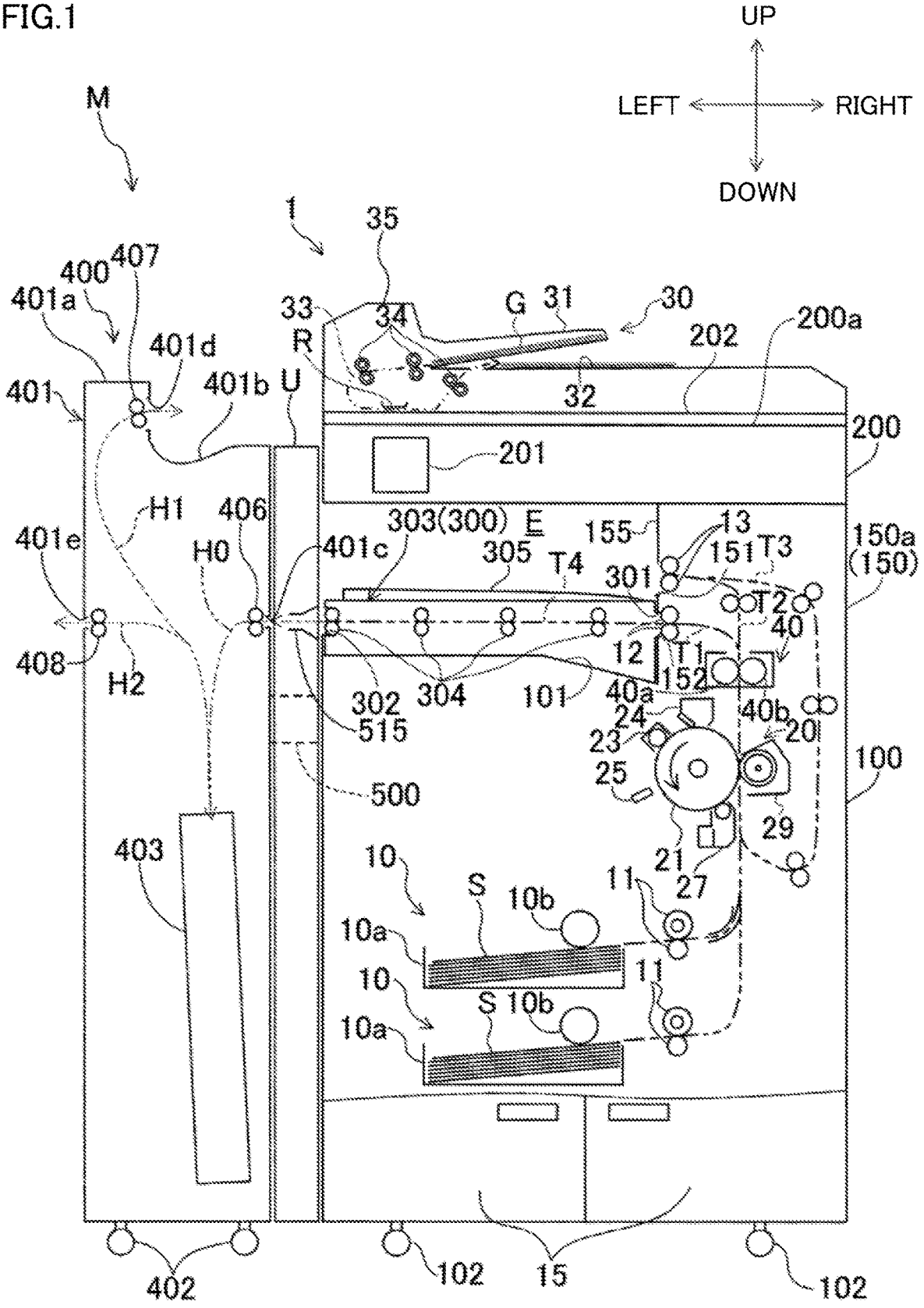
FIG. 1 illustrates a schematic configuration of an image forming system including a conveyance guide unit according to an embodiment, an image forming apparatus, and a post-processing device.

FIG. 1 illustrated an image forming system M including: a conveyance guide unit 900 according to the present embodiment; an image forming apparatus 1; and a post-processing device 400 attached to the image forming apparatus by the conveyance guide unit 900.

Hereinafter, "front" and "back" means the front and back of the image forming apparatus 1, and "right" and "left" means the right and left of the image forming apparatus 1, unless otherwise noted.

[Configuration of the Image Forming Apparatus 1]

The image forming apparatus 1 is a copier that is configured to internally discharge paper. The image forming apparatus 1 is provided with a main body 100, a scanner housing portion 200, and a coupling housing portion 150.

The scanner housing portion 200 is located above the main body 100. The scanner housing portion 200 is coupled with the main body 100 by the coupling housing portion 150.

An internal paper discharge space E is provided between the main body 100 and the scanner housing portion 200. The coupling housing portion 150 is provided with a back side fitting part (not shown) and a right side fitting part 150*a*. The back side fitting part is attached to a back end part of the main body 100. The right side fitting part 150*a* is attached to a right end part of the main body 100.

The right side fitting part 150*a* is provided with a vertical wall 155 that faces the internal paper discharge space E (see FIG. 1). The vertical wall 155 has an upper discharge port 151 and a lower discharge port 152 that are vertically arranged.

In the internal paper discharge space E, a relay conveyance device 300 is installed in a detachable manner. After a sheet S is subjected to image forming and discharged from the lower discharge port 152, the relay conveyance device 300 delivers the sheet S to the post-processing device 400.

A contact glass plate 200*a* is provided on the top of the scanner housing portion 200. An upper surface of the contact glass plate 200*a* is closed by a document cover 202 such that it can be opened and closed.

An automatic document feeding device 30 is integrally attached to the top of the document cover 202. A reading unit 201 is loaded inside the scanner housing portion 200.

The reading unit 201 optically reads an image on a document sheet G by a flatbed scanning method or a sheetfed scanning method to be described later. The reading unit 201 is provided with a CIS sensor that reads a document image by a photoelectric conversion; the reading unit 201 is configured to slide in a right-left direction.

The automatic document feeding device 30 is supported by a back end part of the scanner housing portion 200 with a pair of hinge mechanisms such that it can be turned. In the sheetfed scanning method, the automatic document feeding device 30 delivers the document sheet G to a document reading position R of an upper surface of the contact glass plate 200*a*.

Specifically, the automatic document feeding device 30 is provided with a document feed tray 31, a document output tray 32, a document conveyance path 33, multiple pairs of conveying rollers 34, and a casing 35.

The document output tray 32 is provided below the paper feed tray 31. The document conveyance path 33 is U-shaped, extending from the document feed tray 31 to the document output tray 32. The multiple pairs of the conveying rollers 34 are arranged along the document conveyance path 33. The multiple pairs of the conveying rollers 34 constitute an example of a paper conveyance mechanism that conveys the document sheet G through the document conveyance path 33. The casing 35 contains the multiple pairs of the conveying rollers 34.

Figure 2:
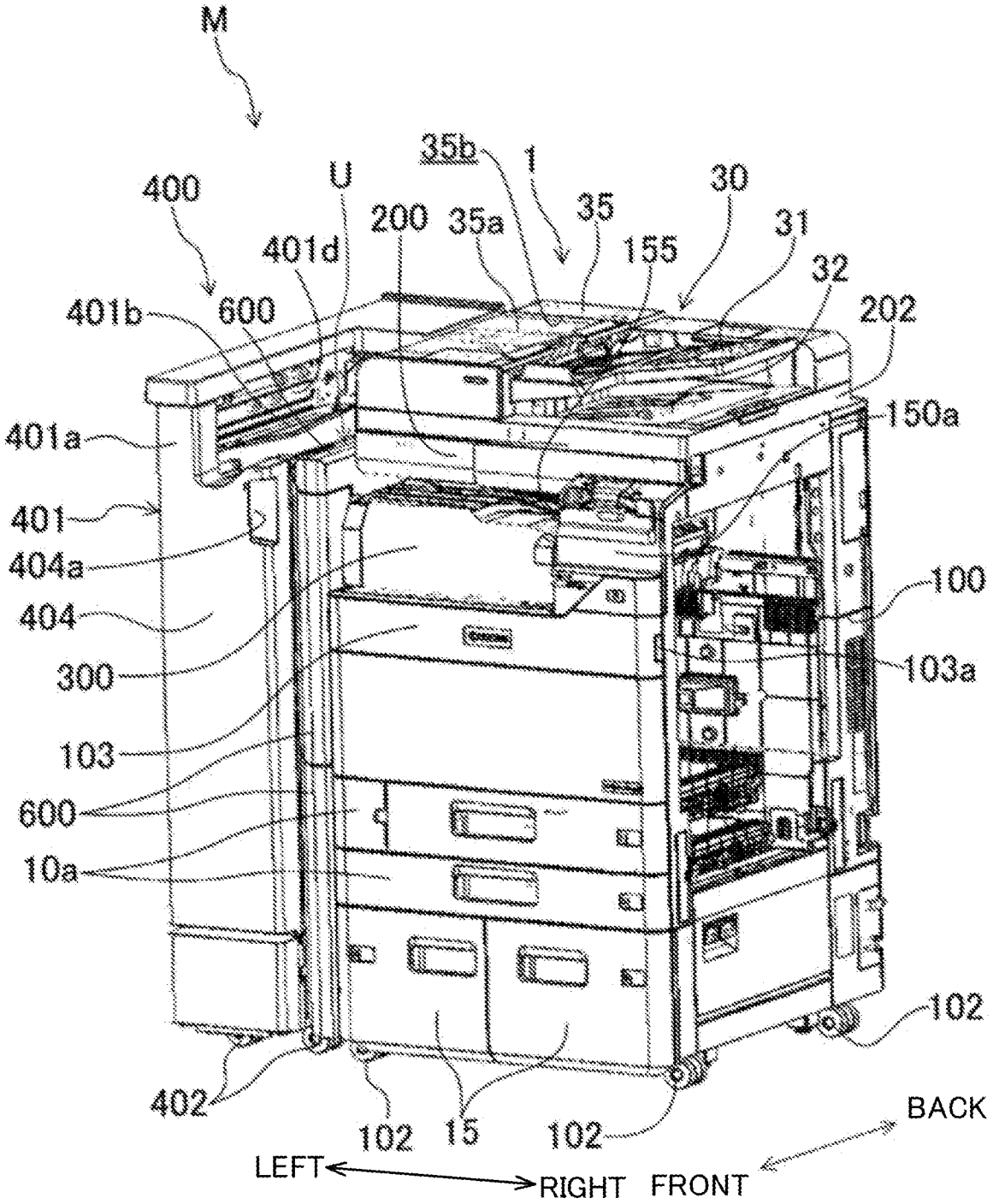
FIG. 2 is a perspective view of an exterior of the image forming system.
Figure 26:
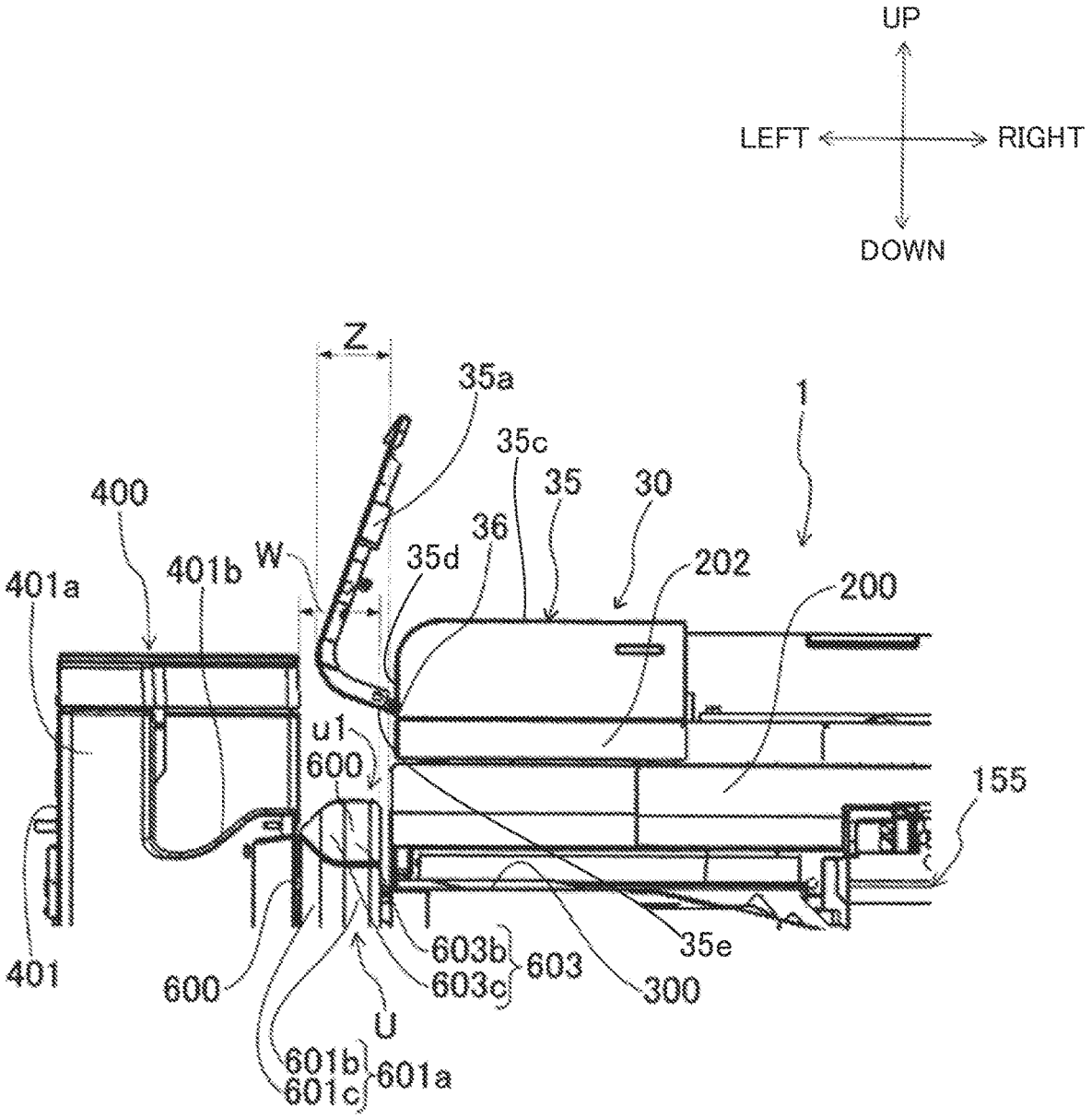
FIG. 26 is an enlarged plan view of upper end parts of the post-processing device, the image forming apparatus, and the external cover of the conveyance guide unit along with a reclosable cover of an automatic document feeder being opened, when viewed from the front side.

The casing 35 has an opening part 35*b* for removing jammed paper; the opening part 35*b* extends from a top wall surface 35*c* of the casing 35 to a side wall surface 35*d* of the casing 35, which is adjacent to the post-processing device 400 (see FIGS. 2 and 26). The opening part 35*b* is closed by a reclosable cover 35*a* such that it can be opened and closed.

The reclosable cover 35*a* is supported by the casing 35. An end edge part 35*e* of the reclosable cover 35*a*, which is adjacent to the post-processing device 400, is supported such that the reclosable cover 35*a* can be turned about an axis 36 extending in a front-back direction (see FIG. 26 to be described later).

The reclosable cover 35*a* is configured to turn about the axis 36, moving between a closed position at which the opening part 35*b* is closed and a wide-open position at a predetermined angle upward from the close position.

In the sheetfed scanning method, the automatic document feeding device 30 sends document sheets G set on the document feed tray 31 downstream one by one, with the multiple pairs of the conveying rollers 34. Subsequently, the automatic document feeding device 30 conveys the document sheet G to the document output tray 32 through the document reading position R. In the sheetfed scanning method, the reading unit 201 is disposed immediately below the document reading position R and reads an image on the document sheet G passing through the document reading position R.

In contrast, in the flatbed scanning method, the document cover 202 is turned up from a closed position with respect to the hinge mechanisms in a back end part of the document cover 202, prior to image reading. After the document sheet G is set on the upper surface of the contact glass plate 200*a*, the document cover 202 is returned to the closed position such that the document sheet G is kept in place on the upper surface of the contact glass plate 200*a*. In this state, the reading unit 201 performs photoelectric conversion of a reflection from the document sheet G by the ICS sensor provided in the reading unit 201 while sliding in a right-left direction, and thereby generates document image data.

[Configuration of the Main Body 100 of the Image Forming Apparatus 1]

The main body 100 is shaped in an approximately rectangular prism. Casters 102 for moving are attached to a bottom of the main body 100. An image forming portion 20 is provided in the main body 100. In the main body 100, a fixing portion 40 is provided above the image forming portion 20; two paper feed portions 10 are vertically arranged and disposed below and diagonally left to the image forming portion 20.

Each paper feed portion 10 is provided with: a paper cassette 10*a* that loads sheets S inside; and paper pickup rollers 10*b*. The paper pickup rollers 10*b* pick up the sheet S from the paper cassettes 10*a* and send it out. Being sent out from the paper cassette 10*a*, the sheet S is supplied to the image forming portion 20 by a pair of conveying rollers 11.

Furthermore, in the main body 100, large-capacity paper cassettes 15 are disposed side by side below the two paper feed portions 10. The sheet S loaded in the large-capacity paper cassettes 15 is picked up by paper pickup rollers (not shown) and sent out toward the image forming portion 20.

The image forming portion 20 is provided with a photoconductor drum 21, a charging device 23, an exposure device 25, a developing device 27, and a transfer device 29.

In the image forming portion 20, the charging device 23 charges a peripheral surface of the photoconductor drum 21, then the exposure device 25 forms an electrostatic image on the surface of the photoconductor drum 21 by emitting a laser light with reference to the document image data. The document image data is image data generated by the reading unit 201 from a document image.

The developing device 27 forms a toner image on the surface of the photoconductor drum 21 by developing the electrostatic image. The transfer device 29 transfers the toner image onto the sheet S supplied from the paper feed portion 10, then supplies the sheet S carrying the toner image to the fixing portion 40. The code 24 indicates a cleaner that removes toner remaining on the surface of the photoconductor drum 21.

The fixing portion 40 applies pressure and heat to the sheet S supplied from the image forming portion 20 while the sheet S passes through an interface between a fixing roller 40*a* and a pressure roller 40*b*. The fixing portion 40 thereby fixes the toner image onto the sheet S. Having the toner image fixed hereon by the fixing portion 40, the sheet S is conveyed upward by the fixing roller 40*a* and the pressure roller 40*b*.

The sheet S passes through a conveyance path that branches at a position above the fixing portion 40 into a first conveyance path T1 and a second conveyance path T2. Being conveyed by the fixing roller 40*a* and the pressure roller 40*b*, the sheet S passes through the first conveyance path T1 or the second conveyance path T2.

The first conveyance path T1 has a bend immediately above the fixing portion 40 and continues leftward to the lower discharge port 152. A pair of first discharge rollers 12 is disposed immediately upstream of the lower discharge port 152. The pair of the first discharge rollers 12 constitutes an example of a discharge mechanism.

The second conveyance path T2 has a bend above the fixing portion 40 and continues leftward to the upper discharge port 151. A pair of second discharge rollers 13 is disposed immediately upstream of the upper discharge port 151. The second conveyance path T2 further continues to a duplex-printing conveyance path T3. The duplex-printing conveyance path T3 is a conveyance path for duplex printing, through which the sheet S is turned upside down and resupplied to the image forming portion 20.

In a state not shown in the drawings, in which the relay conveyance device 300 is not installed in the internal paper discharge space E, the sheet S is discharged onto a sheet tray 101 from the lower discharge port 152. The upper discharge port 151 is used essentially for turning the sheet S upside down.

In contrast, in the state shown in FIG. 1, in which the relay conveyance device 300 is installed in the internal paper discharge space E, the sheet S is discharged onto a relay conveyance path T4 in the relay conveyance device 300 from the lower discharge port 152.

The relay conveyance device 300 is disposed on the sheet tray 101, which defines the bottom of the internal paper discharge space E. The relay conveyance device 300 is provided with a body case 303 formed in an approximately rectangular prism.

The body case 303 has a sheet carrying-in port 301 on a right wall of the body case 303 itself; the sheet carrying-in port 301 communicates with the upper discharge port 151. The body case 303 has a sheet discharge port 302 on a left wall of the body case 303 itself; the sheet discharge port 302 communicates with a sheet carrying-in port 401*c* of the post-processing device 400. The relay conveyance path T4 is provided in the relay conveyance device 300.

The relay conveyance path T4 extends from the sheet carrying-in port 301 to the sheet discharge port 302 in an approximately horizontal direction. Four pairs of conveying rollers 304 are arranged along the relay conveyance path T4. A paper discharge tray part 305 is formed on the top of the relay conveyance device 300; the paper discharge tray part 305 receives the sheet S from the upper discharge port 151.

[Configuration of the Front Region of the Main Body 100 of the Image Forming Apparatus 1]

Figure 3:
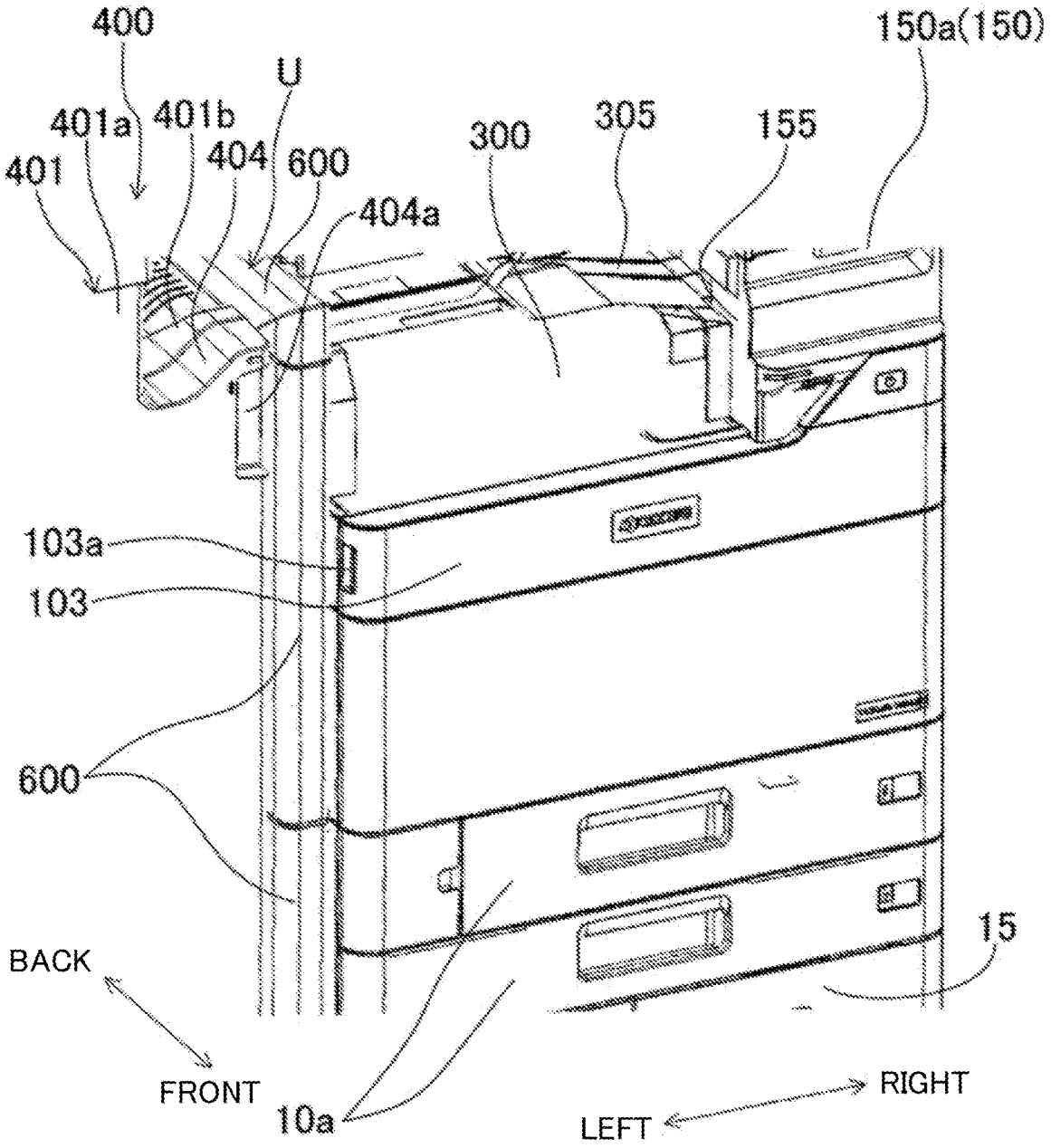
FIG. 3 is an enlarged perspective view of a front region of a main body of the image forming apparatus.

Referring to FIGS. 2 and 3, the two paper cassettes 10*a* and the two large-capacity paper cassettes 15 are disposed in a lower region of the main body 100 such that they can be pulled open frontward. A front cover 103 is provided to cover a part of a front region of the main body 100 located higher than the two paper cassettes 10.

The front cover 103 is shaped in a rectangle that is horizontally long when viewed from the front. The front cover 103 has recessed handle parts 103*a* on a right end part and a left end part of the front cover 103 itself. Only one of the recessed handle portions 103*a* is shown in FIGS. 2 and 3.

The front cover 103 is attached to the main body 100 in a detachable manner. For maintenance, users can detach the front cover 103 therefrom by pulling the recessed handle parts 103*a* with the fingers frontward. The maintenance includes replacing toner containers (not shown), for example.

[Configuration of the Post-Processing Device 400]

The post-processing device 400 is attached to a left-side surface of the main body 100 in a detachable manner, with a conveyance guide unit 900 to be described later.

The post-processing device 400 performs post-processing on the sheet S subjected to image forming. The post-processing is stapling, sorting, and center folding, for example. The sheet S subjected to image forming means a printed sheet.

Specifically, the post-processing device 400 is provided with a cabinet 404 that is long in an up-down direction as illustrated in FIG. 1. Casters 402 for moving are attached to a bottom of the cabinet 401. A post-processing mechanism 403 is provided inside and in a lower region of the cabinet 401.

The cabinet 401 has the sheet carrying-in port 401*c* on a right-side surface of the cabinet 401 itself; the sheet carrying-in port 401*c* receives the sheet S having been printed from the image forming apparatus 1. The cabinet 401 has a discharge housing part 401*a* in a left end part of an upper region of the cabinet 401 itself; the discharge housing part 401*a* is shaped in a rectangular prism protruding upward.

The discharge housing part 401*a* has a first discharge port 401*d* on a right-side surface of the discharge housing part 401*a* itself. A part of a top region of the cabinet 401, adjacent to the right of the discharge housing part 401*a* is formed as a discharge tray part 401*b* on which the sheet S is stacked.

The cabinet 401 has a second discharge port 401*e* on a left-side surface of the cabinet 401 itself; the second discharge port 401*e* is disposed on an opposite side surface of the cabinet 401 to the sheet carrying-in port 401*c*. A lead-in conveyance path H0, a first discharge conveyance path H1, and a second discharge conveyance path H2 are provided in the cabinet 401.

The lead-in conveyance path H0 is a conveyance path extending from the sheet carrying-in port 401*c* to the post-processing mechanism 403. The first discharge conveyance path H1 is a conveyance path stretching from the post-processing mechanism 403 to the first discharge port 401*d*. The second discharge conveyance path H2 is a conveyance path stretching from the post-processing mechanism 403 to the second discharge port 401*e*. Multiple pairs of rollers are arranged along the conveyance paths H0, H1, and H2.

Referring to FIG. 1, a pair of lead-in rollers 406, a pair of first discharge rollers 407 (as an example of a discharge mechanism), and a pair of second discharge rollers 408 are arranged along the conveyance paths H0, H1, and H2, respectively. The other pairs of rollers are omitted from the drawing.

The pair of the lead-in rollers 406 is disposed adjacent to the sheet carrying-in port 401*c*. The pair of the first discharge rollers 407 is disposed adjacent to the first discharge port 401*d*. The pair of the second discharge rollers 408 is disposed adjacent to the second discharge port 401*e*.

The pair of the first discharge rollers 407 is disposed in the discharge housing part 401*a*, discharging the sheet S from the first discharge port 401*d* in a direction X1 indicated in FIG. 1. The direction X1 is a direction in which the post-processing device 400 and the image forming apparatus 1 face each other, and is the direction from the post-processing device 400 toward the image forming apparatus 1.

The conveyance path of the sheet S subjected to post-processing by the post-processing mechanism 403 is controlled by a controller of the post-processing device 400. Specifically, the controller switches the position of a conveyance path switch (not shown) provided in the cabinet 401 according to a command from the image forming apparatus 1. The controller thereby switches the conveyance path of the sheet S subjected to post-processing between the first discharge conveyance path H1 and the second discharge conveyance path H2.

The first discharge conveyance path H1 serves to convey the sheet S subjected to post-processing from the first discharge port 401*d* to the discharge tray part 401*b*. The second discharge conveyance path H2 serves to convey the sheet S subjected to post-processing to another post-processing device (not shown) to be provided to the left of the cabinet 401. Alternatively, the second discharge conveyance path H2 serves to convey the sheet S to another discharge tray that is to be provided below the second discharge port 401*e* when the sheet S is a large sheet of paper relatively long in a conveyance direction.

[Configuration of the Conveyance Guide Unit 900]

The conveyance guide unit 900 (see FIG. 1) is a unit that guides the sheet S, which is discharged from the sheet discharge port 302 of the relay conveyance device 300 installed in the image forming apparatus 1, to the sheet carrying-in port 401*c* of the post-processing device 400. The conveyance guide unit 900 ensures that the sheet S be delivered from the relay conveyance device 300 to the post-processing device 400 even when the sheet discharge port 302 of the relay conveyance device 300 and the sheet carrying-in port 401*c* of the post-processing device 400 are different in height. In the present example, the conveyance guide unit 900 is unified into a coupling mechanism 500 to be described later, by which the post-processing device 400 is attached to the main body 100.

Figure 5:
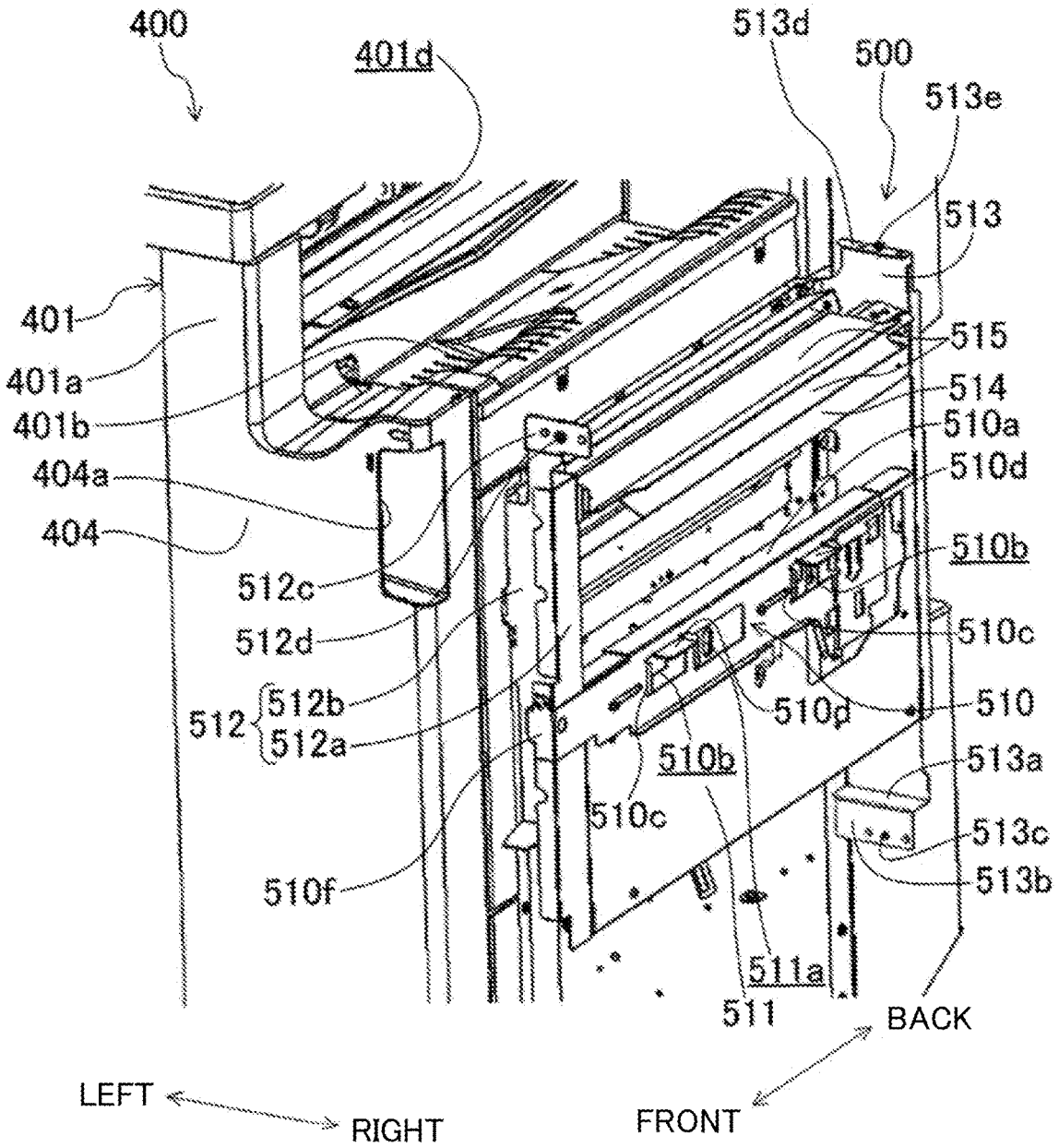
FIG. 5 is a perspective view of an exterior of the post-processing device and the coupling mechanism attached to the post-processing device.

Referring to FIGS. 1 and 5, the conveyance guide unit 900 is provided with a pair of lead-in guide plates 515 and an external cover U. Each lead-in guide plate 515 constitutes a guide member. The lead-in guide plates 515 are spaced in an up-down direction to allow a space between themselves; the space serves as a part of a sheet conveyance path. Each lead-in guide plate 515 is shaped in a rectangular extending in a front-back direction when viewed in plan. The front-back direction is a traverse direction of the sheet conveyance path, which is perpendicular to a sheet conveyance direction. The lead-in guide plates 515 have upstream end parts that are disposed one above the other and face in-between space becoming wider toward the sheet discharge port 302 of the relay conveyance device 300. A front end part and a back end part of the lead-in guide plate 515*s* are respectively supported by a front vertical frame 512 and a back vertical frame 513. The front vertical frame 512 and the back vertical frame 513 constitute the supporting frame. The front vertical frame 512 and the back vertical frame 513 are fixed to the post-processing device 400 with screws.

Figure 10:
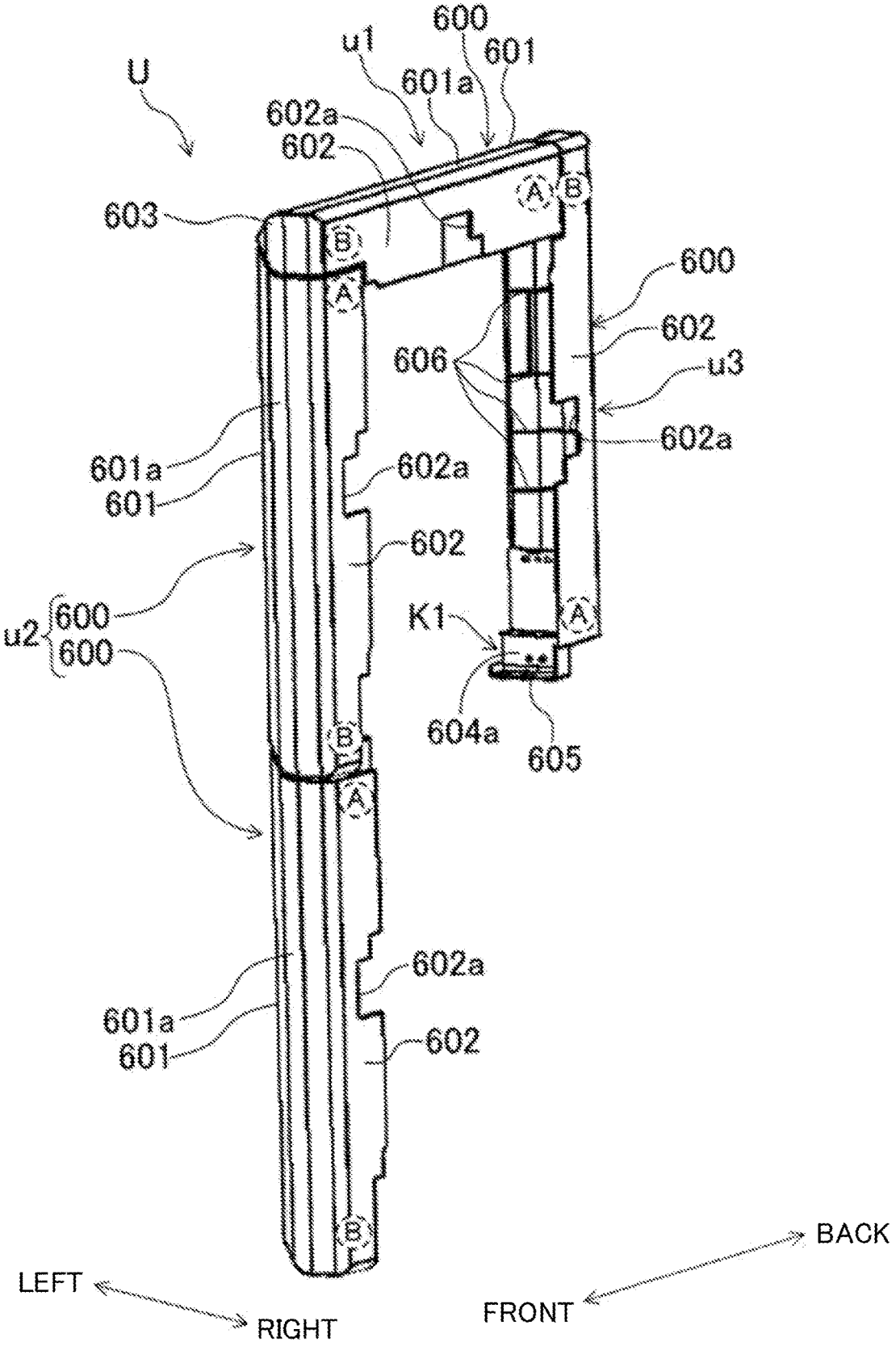
FIG. 10 is a perspective view of an exterior of an external cover of the conveyance guide unit.

Referring to FIG. 10, the external cover U is provided with: an upper portion u1 that extends in a front-back direction and covers an upper part of the pair of the lead-in guide plates 515; a front portion u2 that extends in an up-down direction and covers a front part of the pair of the lead-in guide plates 515; and a back portion u3 that extends in an up-down direction and covers a back part of the pair of the lead-in guide plates 515. The external cover U serves as an external cover to cover the coupling mechanism 500 to be described later as well as the lead-in guide plates 515.

[Configuration of the Coupling Mechanism 500]

Hereinafter, a configuration of the coupling mechanism 500 will be described with reference to FIGS. 4 to 9. The coupling mechanism 500 is provided with: a recessed attachment member 510 disposed on a right-side surface of the post-processing device 400; and a protruding attachment member 520 disposed on the left-side surface of the main body 100 (see FIG. 7).

Figure 4:
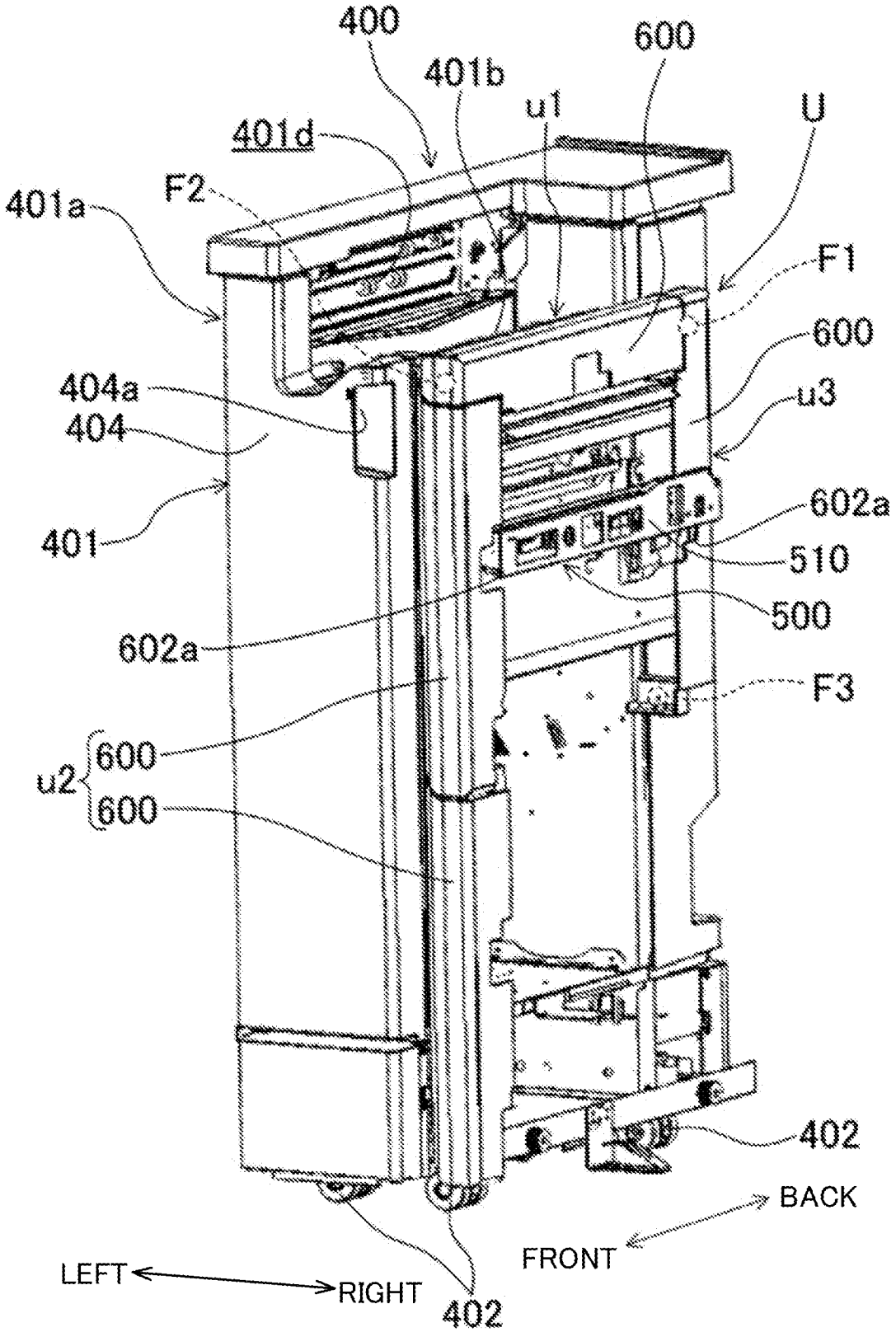
FIG. 4 is a perspective view of an exterior of the post-processing device and the conveyance guide unit including a coupling mechanism attached to the post-processing device.

Referring to FIG. 4, the recessed attachment member 510 is extended to the right of the external cover U and can be engaged with the protruding attachment member 520 of the image forming apparatus 1.

Figure 6:
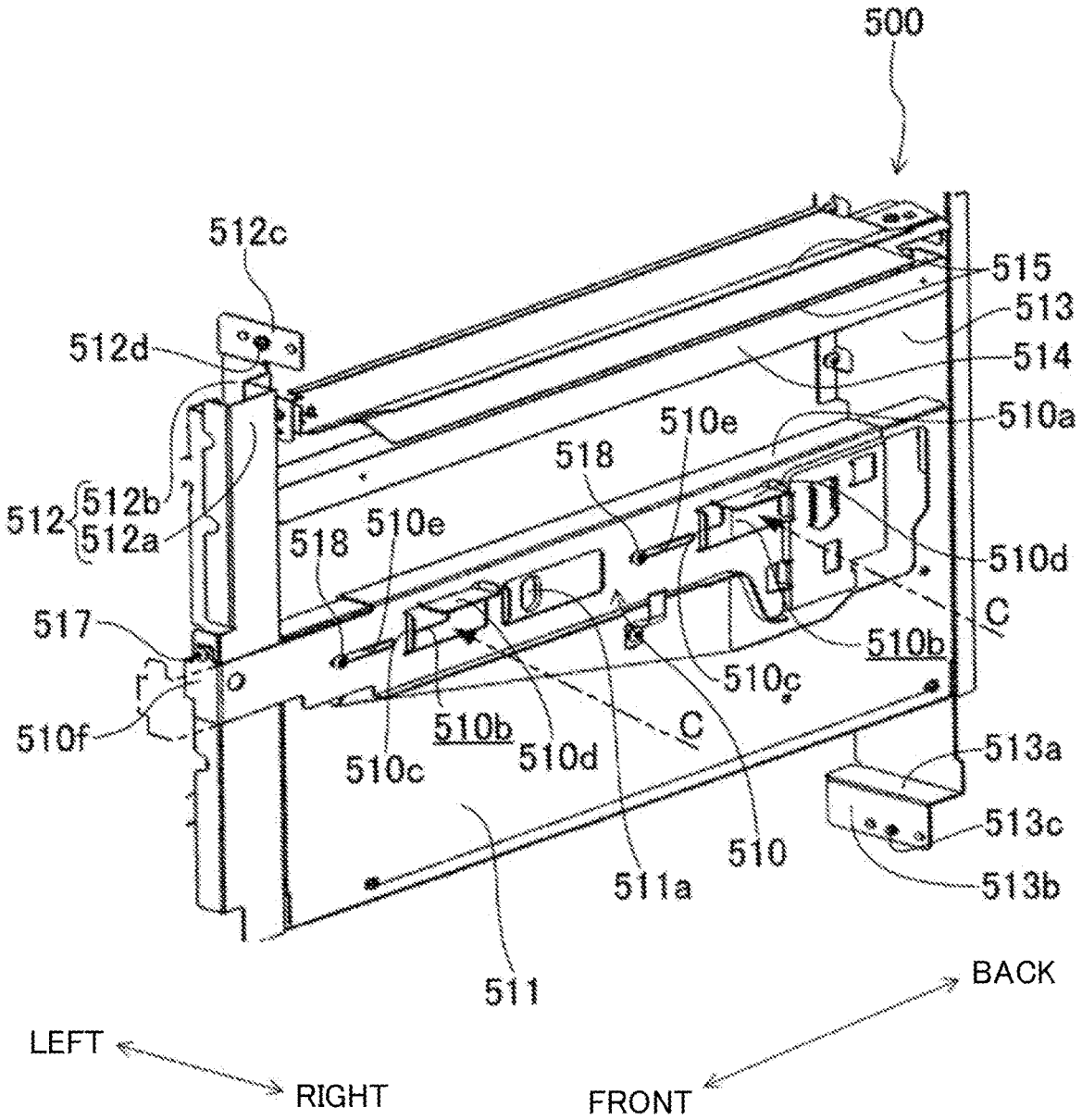
FIG. 6 is a perspective view of an exterior of the coupling mechanism attached to the post-processing device.

Referring to FIGS. 5 and 6, the recessed attachment member 510 is supported by an upper end part of a rectangular vertical plate 511 that is vertically fixed, such that the recessed attachment member 510 can slide in a front-back direction.

A front end part and a back end part of the vertical plate portion 511 are respectively fixed to the front vertical frame 512 and the back vertical frame 513 that both extend in an up-down direction. The front vertical frame 512 and the back vertical frame 513 are fixed to a right-side surface of the cabinet 401 of the post-processing device 400 with screws, for example.

An upper part of the front vertical frame 512 and an upper part of the back vertical frame 513 are coupled with each other by a stay 514 and the lead-in guide plates 515.

The vertical plate 511 has a positioning hole 511*a* in the upper part of the vertical plate 511 itself (see FIG. 6); the positioning hole 511*a* is drilled across a thickness direction of the vertical plate 511. The positioning hole 511*a* is to be engaged with a positioning pin 522 that protrudes from the protruding attachment member 520 of the image forming apparatus 1. Thickness directions of the vertical plate 511 are right-left directions indicated in FIG. 6.

The recessed attachment member 510 is a sheet metal shaped by bending and extends in a front-back direction. The recessed attachment member 510 has a U-shaped fitting sliding part 510*a* that fits in the upper part of the vertical plate 511 in a slidable manner.

A pair of rectangular aperture parts 510*b* and a pair of long holes 510*e* are formed in a plate part of the recessed attachment member 510, which faces the right-side surface of the vertical plate 511. The rectangular aperture parts 510*b* are arranged separately in a front-back direction. Each long hole 510*e* is disposed to the front of each rectangular aperture part 510*b*.

The long hole 510*e* is constituted by a slit-like hole extending in a front-back direction. The recessed attachment member 510 is fixed to the vertical plate 511 with screws 518 extending through the long holes 510*e*, such that the recessed attachment member 510 can slide in a front-back direction. A protruding plate part 510*d* protrudes to the right from an upper end edge of the rectangular aperture part 510*b*. Furthermore, a latching part 510*c* protrudes to the right from a front end edge of the rectangular aperture part 510*b*.

Figure 7:
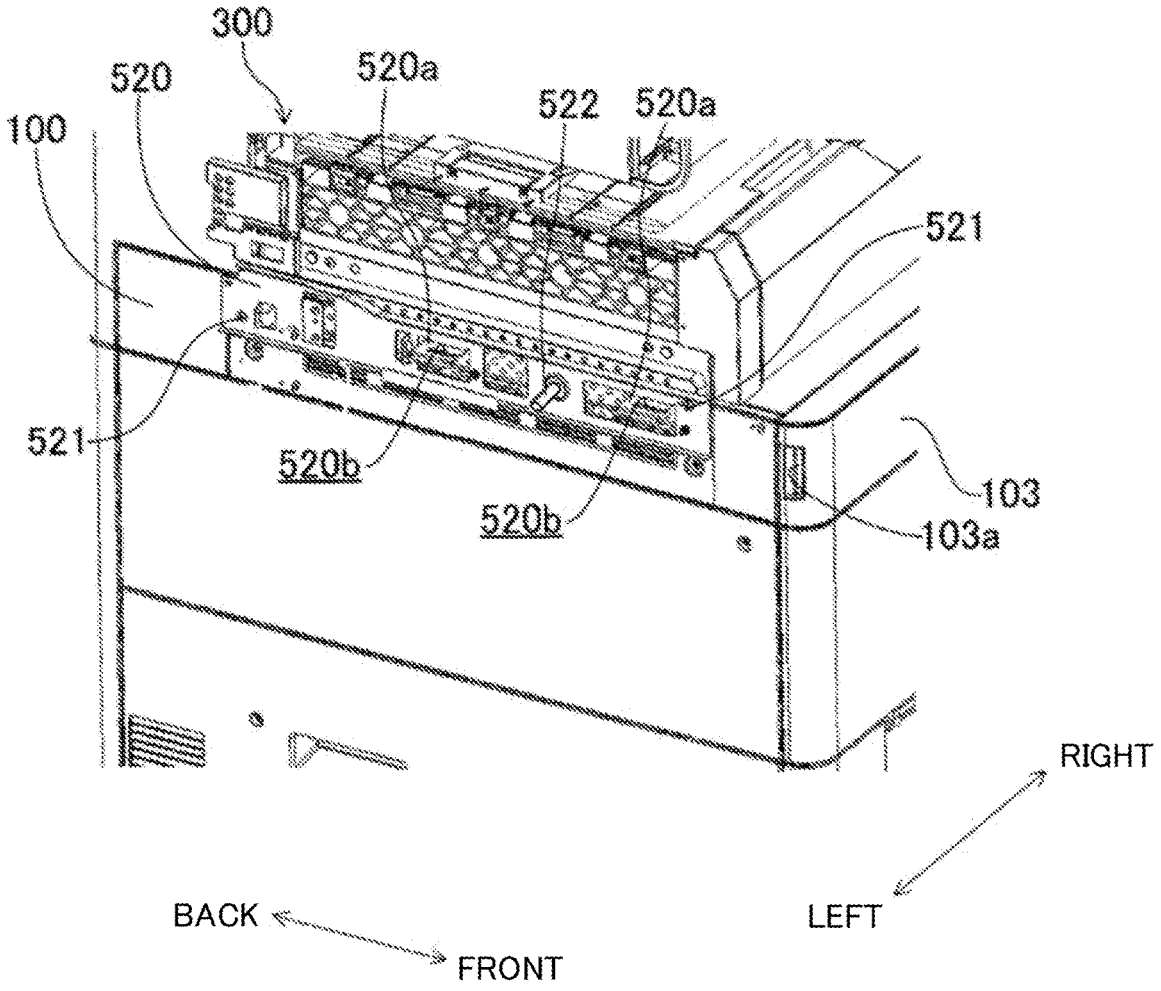
FIG. 7 is a perspective view of a left-side surface of the main body of the image forming apparatus.
Figure 8:
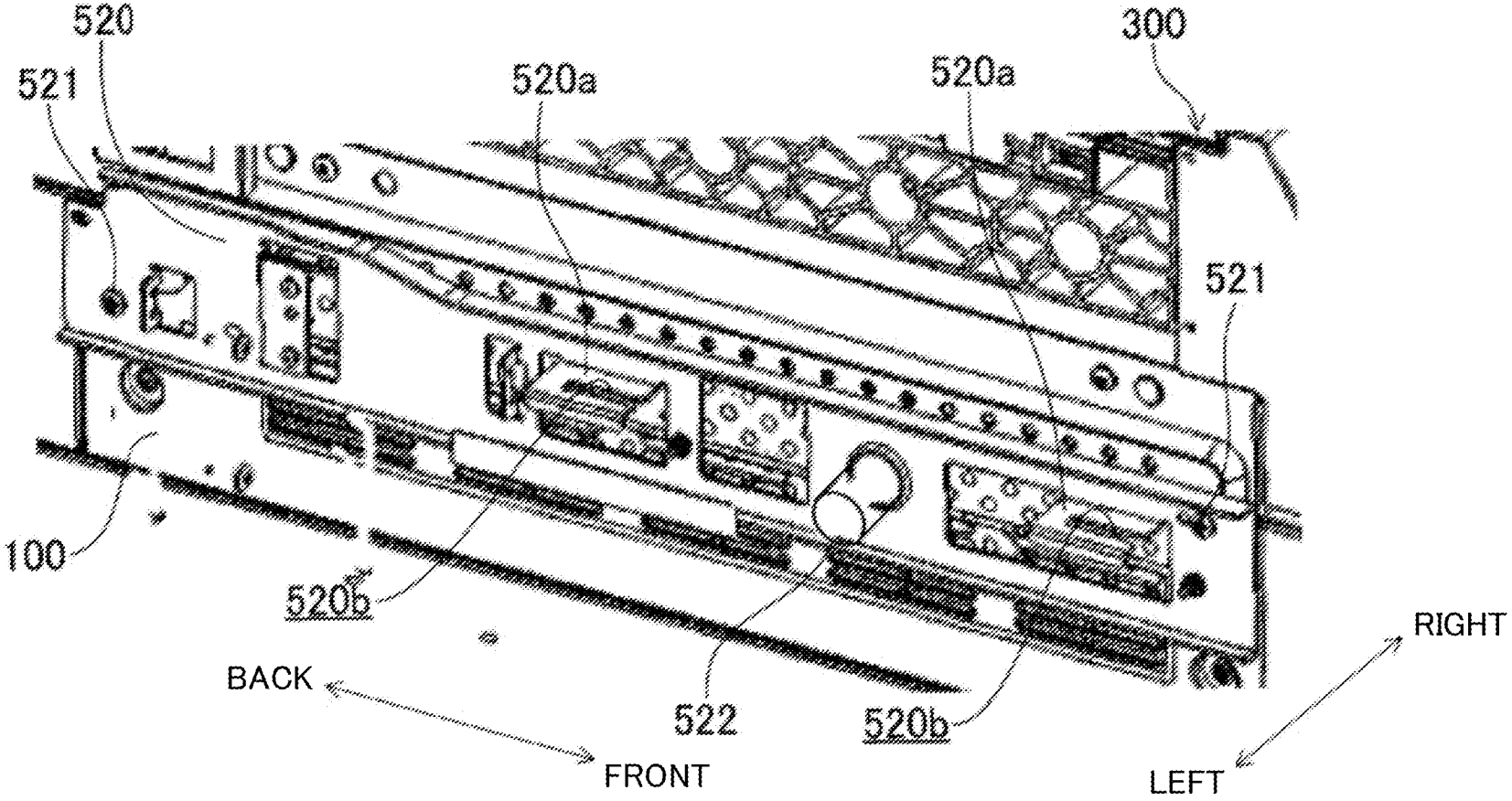
FIG. 8 is an enlarged perspective view of the periphery of a coupled member, located on the left-side surface of the main body of the image forming apparatus.

Referring to FIGS. 7 and 8, the protruding attachment member 520 is a sheet metal shaped by bending and extends in a front-back direction. The protruding attachment member 520 is fixed to a left-side surface of the main body 100 with two screws 521 that are arranged separately on a diagonal line of the protruding attachment member 520.

A pair of protruding plate portions 520*a* protrudes from the left-side surface of the main body 100 to the left; the protruding plate portion 520*a* is shaped by bending. Each protruding plate portion 520*a* has a slit-like groove part 520*b* that extends in a front-back direction and is open to the front.

Figure 9:
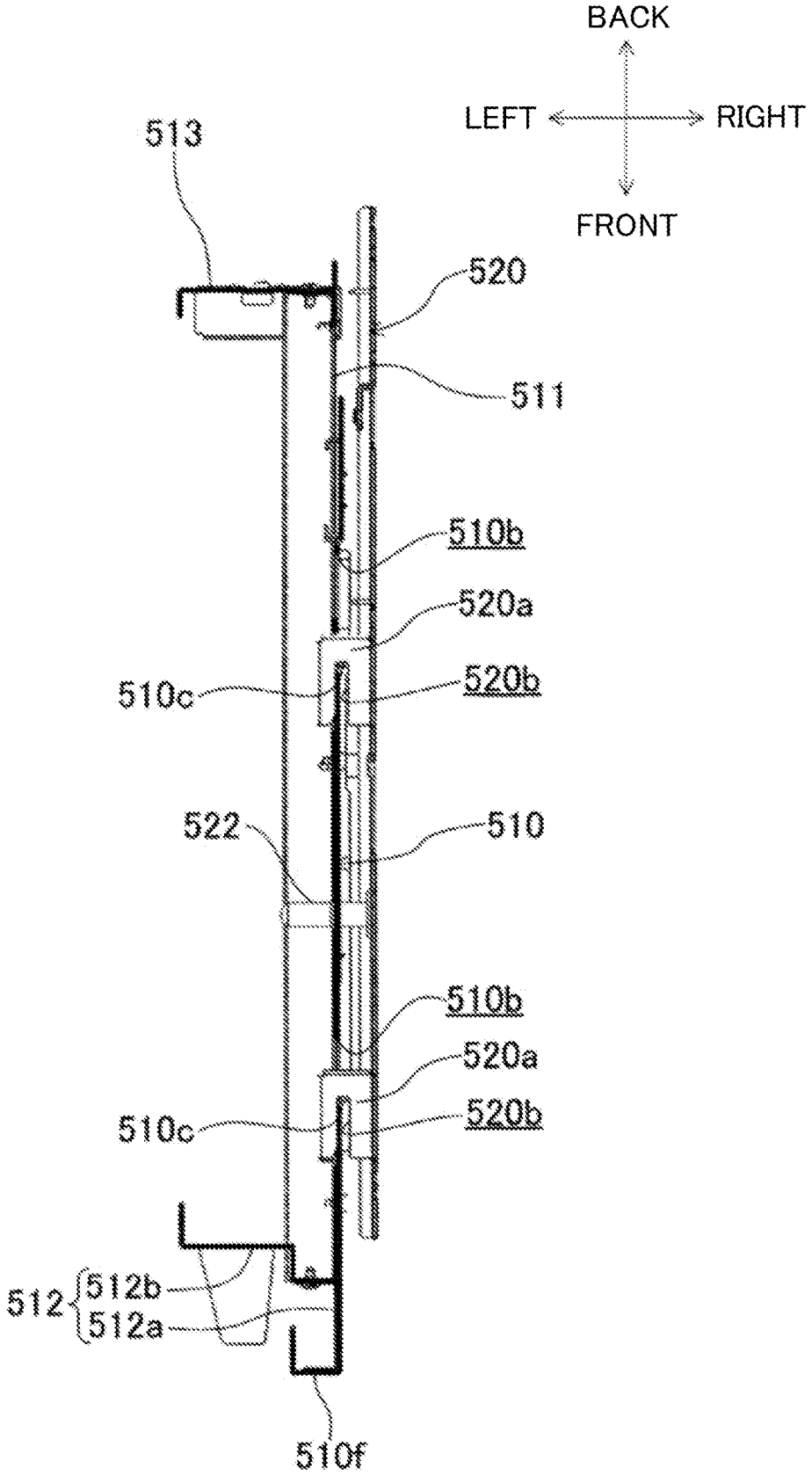
FIG. 9 is a horizontal sectional view of the coupling member and the coupled member of the coupling mechanism in a state of being engaged with each other.

FIG. 9 is a horizontal sectional view of the recessed attachment member 510 fixed to the post-processing device 400 and the protruding attachment member 520 fixed to the main body 100, being engaged with each other. To attach the post-processing device 400 to the main body 100, the pair of the protruding plate portions 520*a* of the protruding attachment member 520 is inserted through the pair of the rectangular apertures part 510*b* of the recessed attachment member 510 in a direction indicated by an arrow C of FIG. 6. The pair of the protruding plate portions 520*a* is inserted through the pair of the rectangular aperture parts 510*b* of the recessed attachment member 510 when the recessed attachment member 510 is at a detached position. The recessed attachment member 510 is then slid to the tack until a predetermined attached position.

In this state, the latching part 510*c* of the recessed attachment member 510 is engaged with the groove part 520*b* of the protruding plate portion 520*a* of the protruding attachment member 520. The latching part 510*c* is formed at the front end edge of the rectangular aperture part 510*b* of the recessed attachment member 510. When the recessed attachment member 510 is slid back to the front until the detached position, the latching part 510*c* is released from the slit-like groove part 520*b*, and thereby the recessed attachment member 510 and the protruding attachment member 520 are disengaged from each other.

When the recessed attachment member 510 is slid again to the back until the attached position, the recessed attachment member 510 and the protruding attachment member 520 are again engaged with each other. Users can slide the recessed attachment member 510 manually.

Furthermore, after the recessed attachment member 510 and the protruding attachment member 520 are engaged with each other, a U-shaped frame portion 512*a* of the front vertical frame 512 is slid from the front and engaged with a latching part 510*f* of the recessed attachment member 510, and then fixed thereto with a screw 517 (see FIG. 6). This will prevent the recessed attachment member 510 from being accidentally moved to the front and detached from the protruding attachment member 520.

[Configuration of the Front Vertical Frame 512 and the Back Vertical Frame 513]

Referring to FIG. 6, the front vertical frame 512 is provided with the U-shaped frame portion 512*a* and a flat frame portion 512*b*. The U-shaped frame portion 512*a* is shaped in a U-shape that is open to the left. The flat frame portion 512*b* extends in an up-down direction and is coupled with a back end edge of the U-shaped frame portion 512*a*.

The flat frame portion 512*b* has a rectangular plate part 512*c* that is formed in the upper end part and is long in a right-left direction. The rectangular plate part 512*c* has a tapped hole 512*d* that is drilled across a thickness direction of the rectangular plate part 512. The tapped hole 512*d* is used for fixing the external cover U as to be described later.

The back vertical frame 513 is flat, facing to the flat frame portion 512*b* of the front vertical frame 512. Referring to FIG. 5, the back vertical frame 513 has a bent plate part 513*d* that is formed in the upper end part and horizontally extends to the front. The bent plate part 513*d* has a tapped hole 513*e* that is drilled through the bent plate part 513*d* in an up-down direction.

The tapped hole 513*e* is used for fixing the external cover U as to be described later. The back vertical frame 513 has a horizontal plate part 513*a* and a vertical plate part 513*b* that are formed in the lower end part. The horizontal plate part 513*a* extends to the front horizontally, and the vertical plate part 513*b* extends from a front end edge of the horizontal plate part 513*a*. The vertical plate part 513*b* has a tapped hole 513*c* that is drilled across a thickness direction of the vertical plate part 513*b*. The tapped hole 513*c* is used for fixing the external cover U as to be described later.

[Detailed Configuration of the External Cover U]

Hereinafter, a configuration of the external cover U will be described with reference to FIGS. 10 to 21. The external cover U is composed of a combination of the identically shaped cover members 600. In the present embodiment, the external cover U includes four cover members 600.

For a better understanding of the combined structure of the cover members 600, in these drawings, a character "A" is given to a first end part of the cover member 600, and a character "B" is given to a second end part of the cover member 600.

The external cover U includes an upper portion u1, a front portion u2, and a back portion u3. The upper portion u1 horizontally extends in a front-back direction of the image forming apparatus 1 and is disposed such that it covers an upper part of the coupling mechanism 500 including the lead-in guide plates 515. The front portion u2 extends downward from a front end part of the upper portion u1 and is disposed such that it covers a front part of the coupling mechanism 500 including the lead-in guide plates 515.

The back portion u3 extends downward from a back end part of the upper portion u1 and is disposed such that it covers a back part of the coupling mechanism 500 including the lead-in guide plates 515. It is less necessary to cover the back part of the coupling mechanism 500 because it is in a blind spot for users standing to the front of the image forming apparatus 1. So, the back portion u3 of the external cover U includes only one cover member 600. The back portion u3 is shorter in length than the front portion u2 which is constituted by the two cover members 600 arranged in series.

Figure 11:
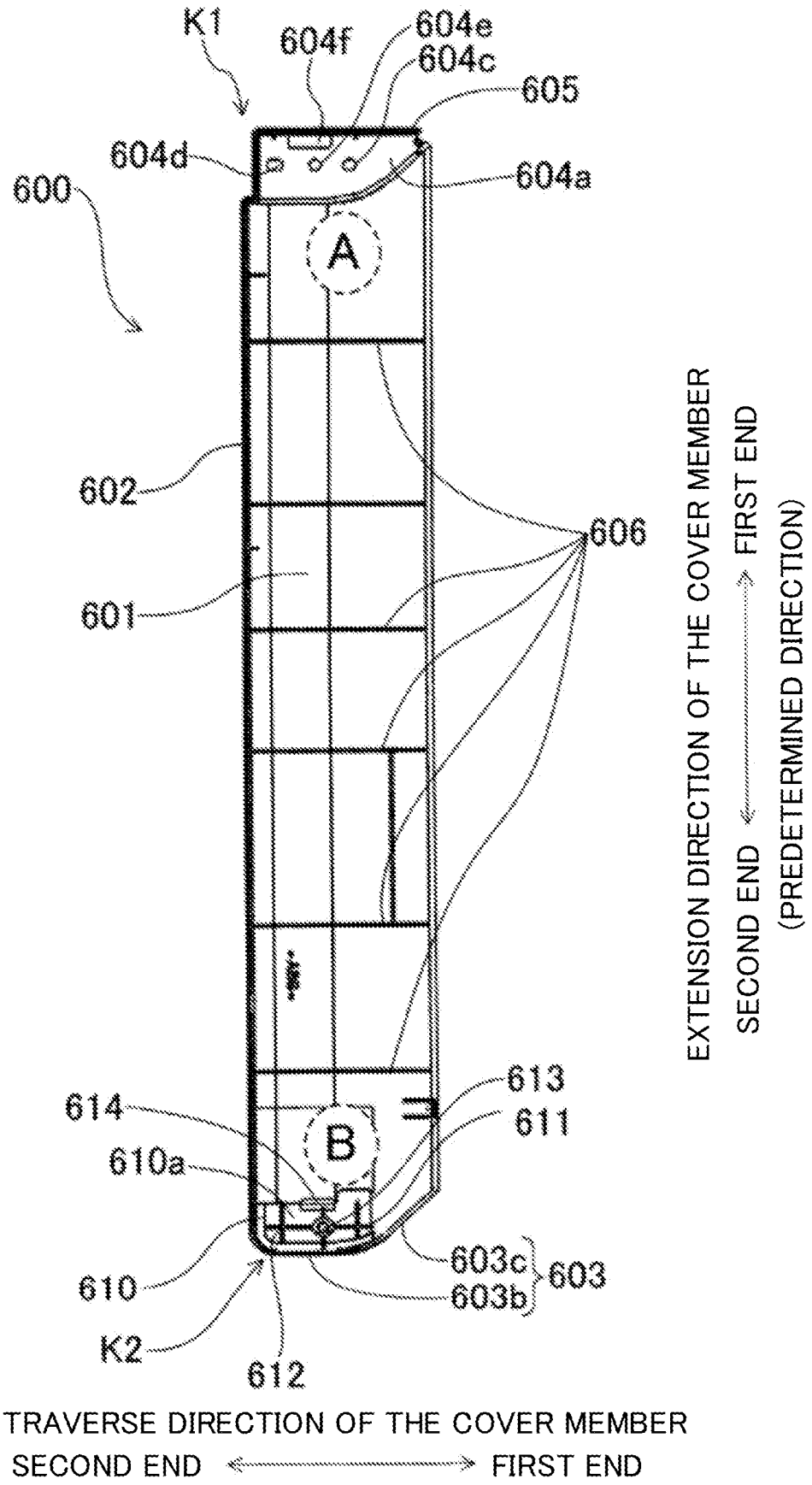
FIG. 11 is a side view of a cover member when viewed from a back side of a front-back direction.
Figure 12:
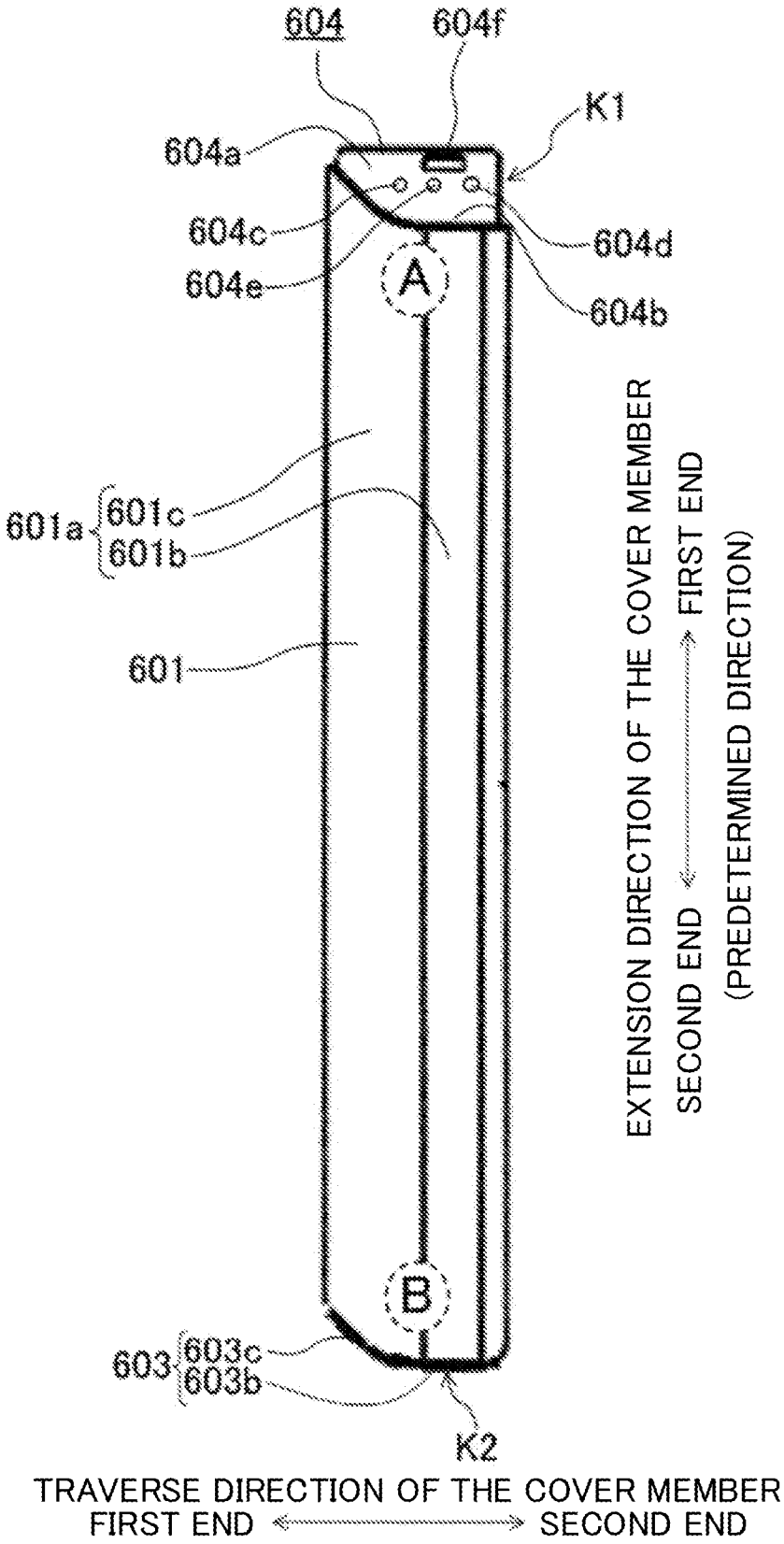
FIG. 12 is a side view of the cover member when viewed from a front side of the front-back direction.

Referring to FIGS. 11 and 12, the cover member 600 is a resin member that extends in an up-down direction of FIGS. 11 and 12. The cover member 600 is a molding produced by injection molding. The cover member 600 should not be limited to a resin member; the cover member 600 may be a metallic member. The cover member 600 should not be limited to a molded member; the cover member 600 may be a sheet metal member subjected to bending or pressing.

Figure 13:
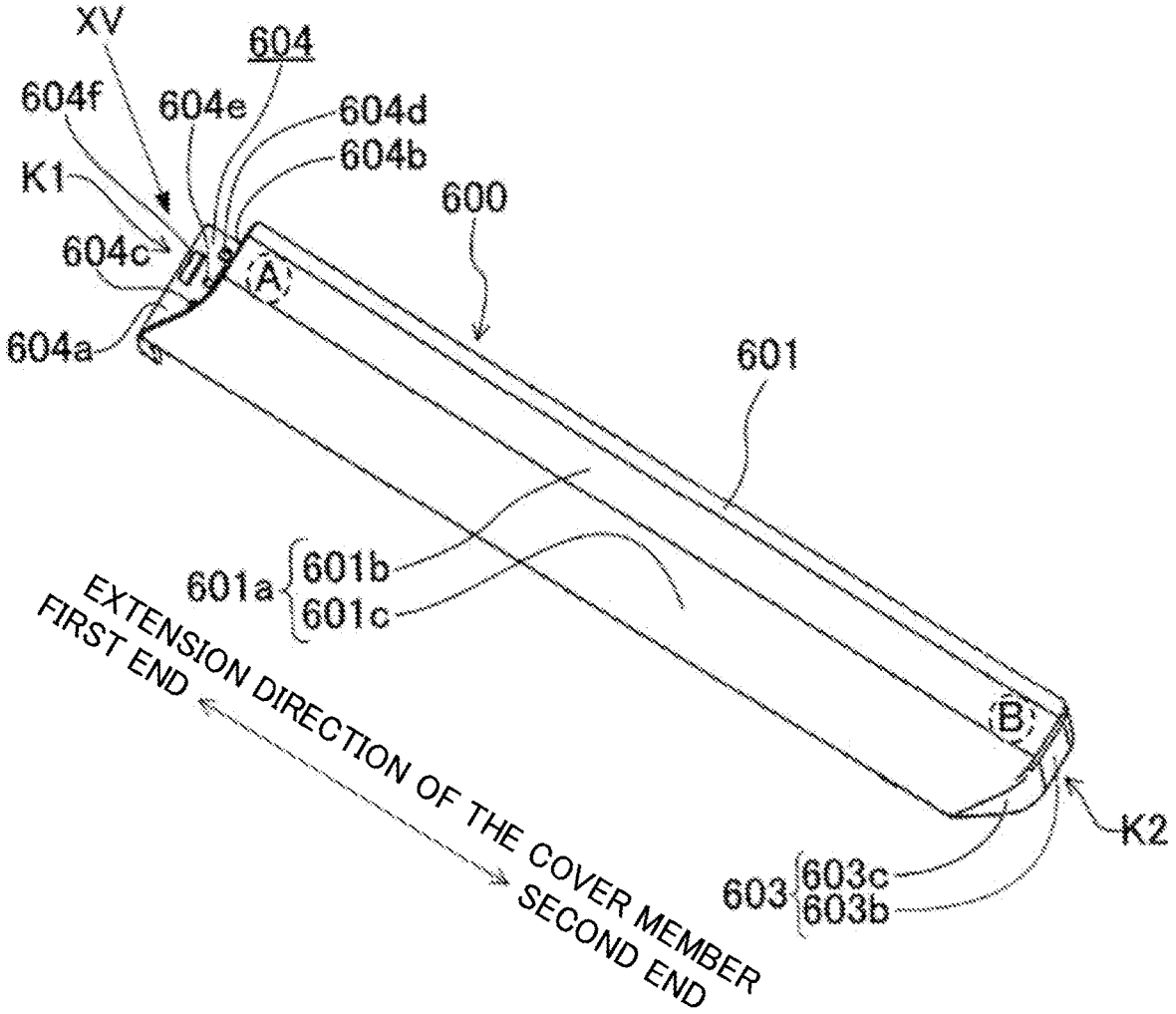
FIG. 13 is a perspective view of an exterior of the cover member.

The cover member 600 has a long wall 601 that extends in a predetermined direction of the cover member 600. Referring to FIGS. 12 and 13, the long wall 601 has an outer surface 601*a*; the outer surface 601*a* has a rectangular flat part 601*b* and an inclined surface 601*c* that extends smoothly from a traverse end edge of the flat part 601*b*. The outer surface 601*a* of the long wall 601 is a designed surface.

The long wall 601 has a flat side wall 602 that extends from an end edge of the long wall 601 to the back of the cover member 600 (see FIG. 11). The side wall 602 has an approximately rectangular cutout part 602*a* at an intermediate position of the side wall 602 in an extension direction thereof (see FIG. 10). The long wall 601 and the side wall 602 are coupled with multiple inner ribs 606 that are arranged at intervals in an extension direction of the cover member 600 (see FIG. 11).

The cover member 600 has a first fitting portion K1 at the first end and a second fitting portion K2 at the second end in an extension direction of the cover member 600 itself. Any two of the cover members 600 can be coupled with each other by the first fitting portion K1 of one of the two cover members 600 and the second fitting portion K2 of the other one of the two cover members 600, being coupled with each other.

In the present embodiment, any two of the cover members 600 are configured such that the first fitting portion K1 of one of the two cover members 600 and the second fitting portion K2 of the other one of the cover members 600 can be re-coupled to be in a linear fitting state or a right-angle fitting state selectively. In the linear fitting state, the two cover members 600 are coupled to form a line so that their extension directions are the same (see FIG. 18 to be described later). In the right-angle fitting state, the two cover members 600 are coupled to form an L-shape so that their extension directions are perpendicular to each other (see FIG. 21 to be described later).

As described above, any two of the cover members 600 are configured to be re-coupled to be in the linear fitting state or the right-angle fitting state. The external cover U thereby can be flexibly reshaped, not only into the shape illustrated in FIG. 10.

[Configuration of the First Fitting Portion K1]

A configuration of the first fitting portion K1 will be described with reference to FIGS. 11 to 15. The first fitting portion K1 has a recessed part 604 that is recessed from the outer surface 601*a* to the back of the cover member 600. The recessed part 604 is open to an extension direction of the cover member 600 and is open to a traverse direction of the cover member 600 without being closed by the side wall 602. Referring to FIG. 12, the recessed part 604 is open to the top and to the right.

The recessed part 604 is shaped by a base surface 604*a* and a side surface 604*b*. The base surface 604*a* is a flat surface that is perpendicular to a front-back direction of the cover member 600. The front-back direction of the cover member 600 is perpendicular to the surface of the sheet of FIG. 12. The side surface 604*b* rises from an end edge of the base surface 604*a* in an extension direction of the cover member 600. A surface opposite to the base surface 604*a* has a U-shaped wall 605 that rises from a peripheral part of the base surface 604*a* and is continued to the side wall 602 (see FIG. 11 and other drawings).

The base surface 604*a* has positioning holes 604*c* and 604*d* that are arranged in a traverse direction of the cover member 600. The base surface 604*a* further has a through hole 604*e* between the positioning holes 604*c* and 604*d*. The base surface 604*a* still further has a rectangular idle hole 604*f* that is long in a traverse direction of the cover member 600. The idle hole 604*f* is located toward the first end part of the cover member 600 in the extension direction from the positioning holes 604*c* and 604*d*.

Figure 14:
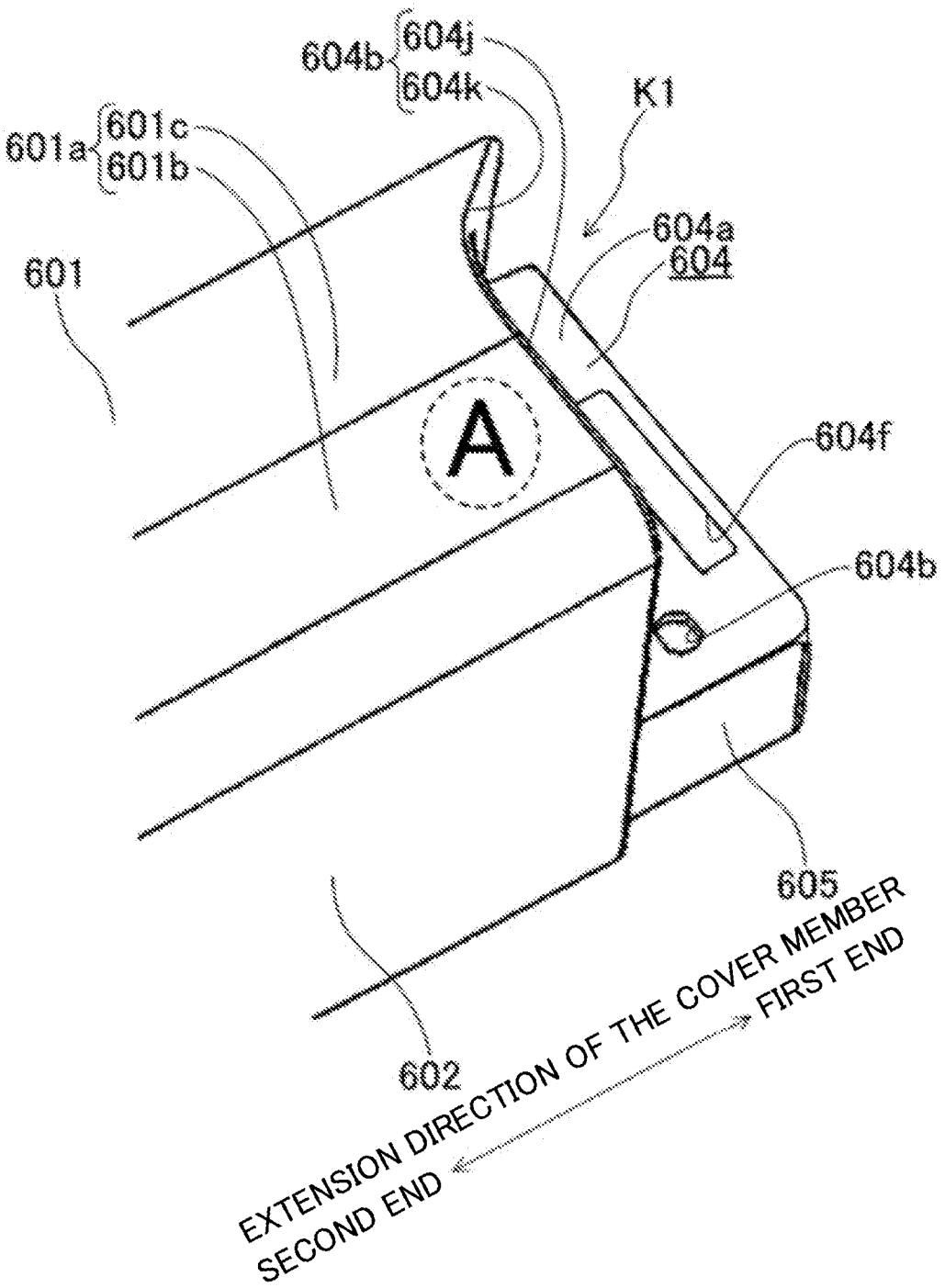
FIG. 14 is an enlarged perspective view of a first end part of the cover member in an extension direction of the cover member.
Figure 15:
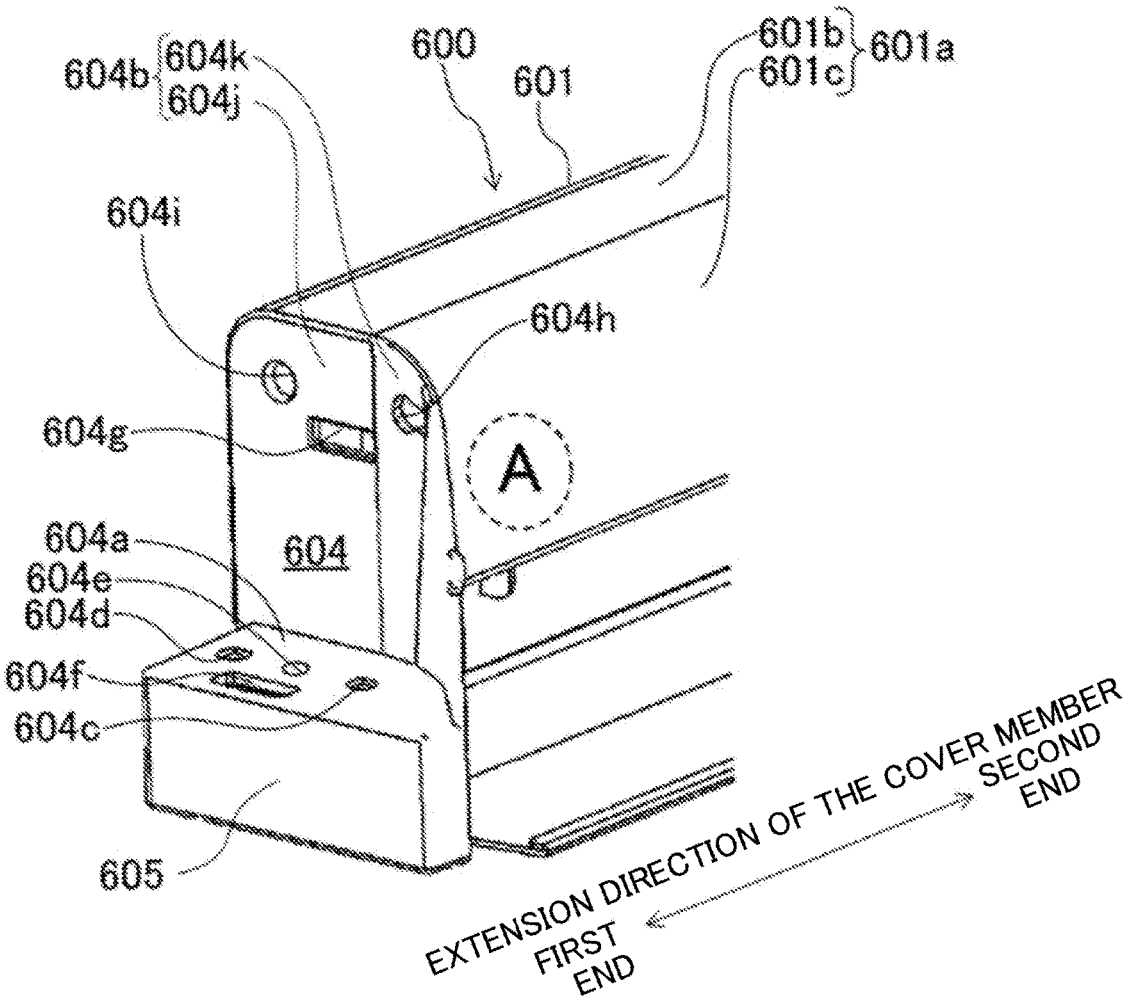
FIG. 15 is a perspective view of the cover member when viewed in a direction XV indicated in FIG. 13.

Referring to FIGS. 14 and 15, the side surface 604*b* has a flat surface 604*j* and an inclined surface 604*k*. The flat surface 604*j* extends in a traverse direction of the cover member 600. The inclined surface 604*k* extends smoothly from a traverse end edge of the flat surface 604*j* at a predetermined angle. The side surface 604*b* is formed in an approximate shape of the letter J when viewed from the front of the cover member 600. The side surface 604*b* serves as a shaped-to-fit part.

Referring to FIG. 15, the side surface 604*b* of the recessed part 604 has a rectangular latching hole 604*g* that is long in a traverse direction of the cover member 600 and further has positioning holes 604*h* and 604*i*. The positioning holes 604*h* and 604*i* are located toward the front of the front-back direction of the cover member 600 from the latching hole 604*g*.

[Configuration of the Second Fitting Portion K2]

Hereinafter, a configuration of the second fitting portion K2 will be described with reference to FIGS. 11 to 13, 16 and 17.

Referring to FIG. 11, the second fitting portion K2 has an end wall 603 and a rectangular base plate 610 (also see FIG. 21 to be described later). The end wall 603 extends from an end edge of the long wall 601 in an extension direction of the cover member 600 to the back of the long wall 601. The base plate 610 extends along an internal surface of a protruding part of the end wall 603 and an internal surface of the side wall 602. A surface of the base plate 610, which is to the back of the cover member 600, constitutes a contact surface 610*a* to be in contact with the base plate 604*a* when the cover members 600 are coupled in line. To the back of the cover member 600 means to the front of the surface of the sheet of FIG. 11.

The base plate 610 has positioning projections 611 and 612 arranged in a traverse direction of the cover member 600. The positioning projections 611 and 612 are both cylindrically shaped. The base plate 610 further has a tapped hole 613 between the positioning projections 611 and 612.

The base plate 610 still further has a latching hook 614 that protrudes from the contact surface 610*a* to the back of the cover member 600. In FIG. 11, the latching hook 614 protrudes toward the surface of the sheet of FIG. 11. The latching hook 614 is located toward the first end part (the middle) of the cover member 600 in an extension direction of the cover member 600 from the tapped hole 613. The latching hook 614 is constituted by a flexible extended plate that faces in an extension direction of the cover member 600 and has a hook part at an outermost end of the extended plate itself. The extension direction of the cover member 600 is an up-down direction of FIG. 11.

Referring to FIGS. 12, 13, 16, and 17, the end wall 603 has a flat surface 603*b* that extends in a traverse direction of the cover member 600 and an inclined surface 603*c* continued from the flat surface 603*b*. The inclined surface 603*c* extends smoothly from a traverse end edge of the flat surface 603*b* at a predetermined angle. The end surface 603 serves as a shaped-to-be-fitted part in which the side surface 604*b* of the recessed part 604 of the first fitting portion K1 can fit. The end surface 603 is a shaped-to-fit part to fit in the side surface 604*b* of the recessed part 604.

[Description of the Linear Fitting State]

Figure 16:
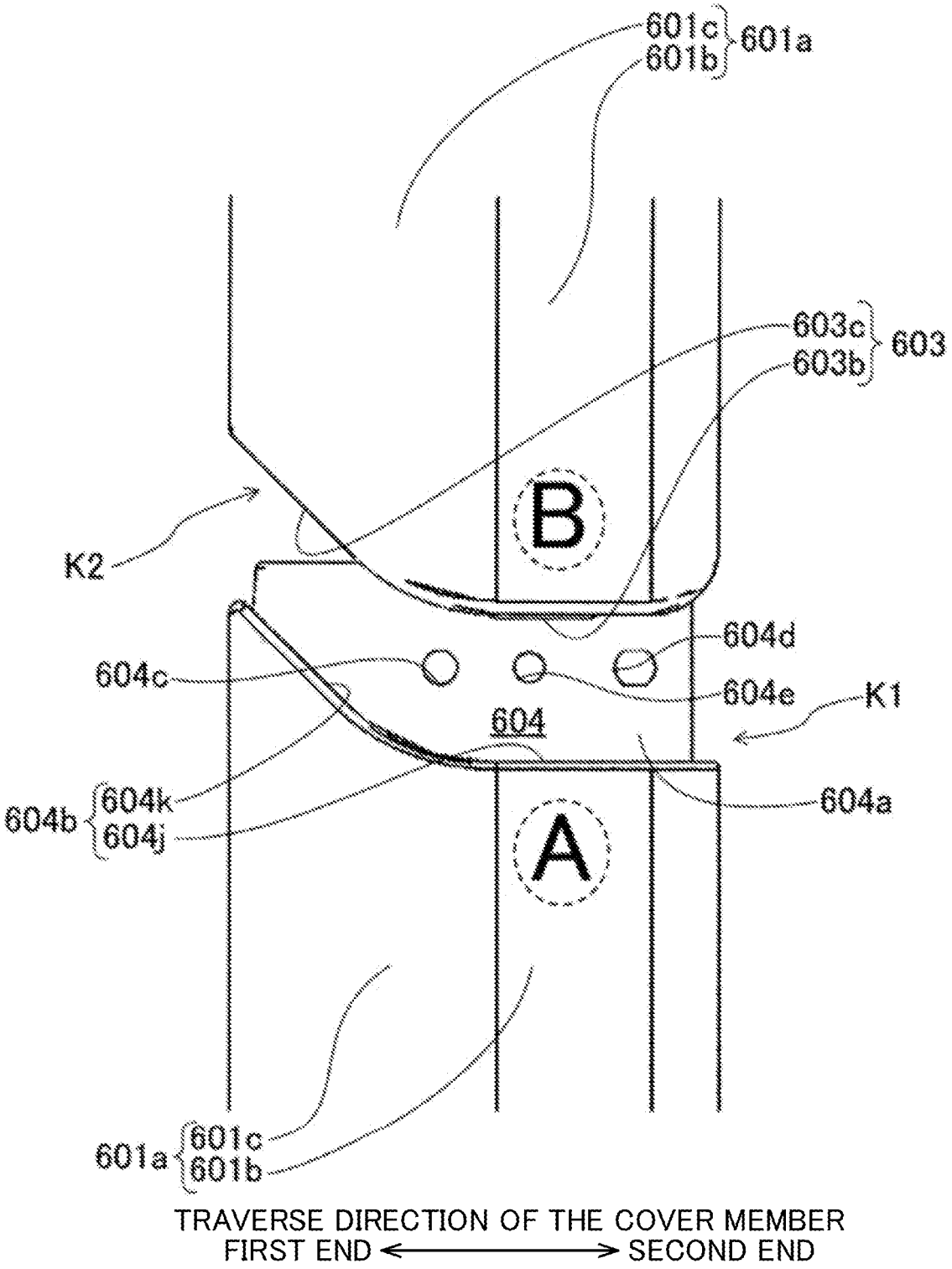
FIG. 16 is an enlarged perspective view of a first fitting portion at the first end part of one of the two cover members and a second fitting portion at a second end part of the other one of the two cover members, when viewed from the front side of the front-back direction.
Figure 17:
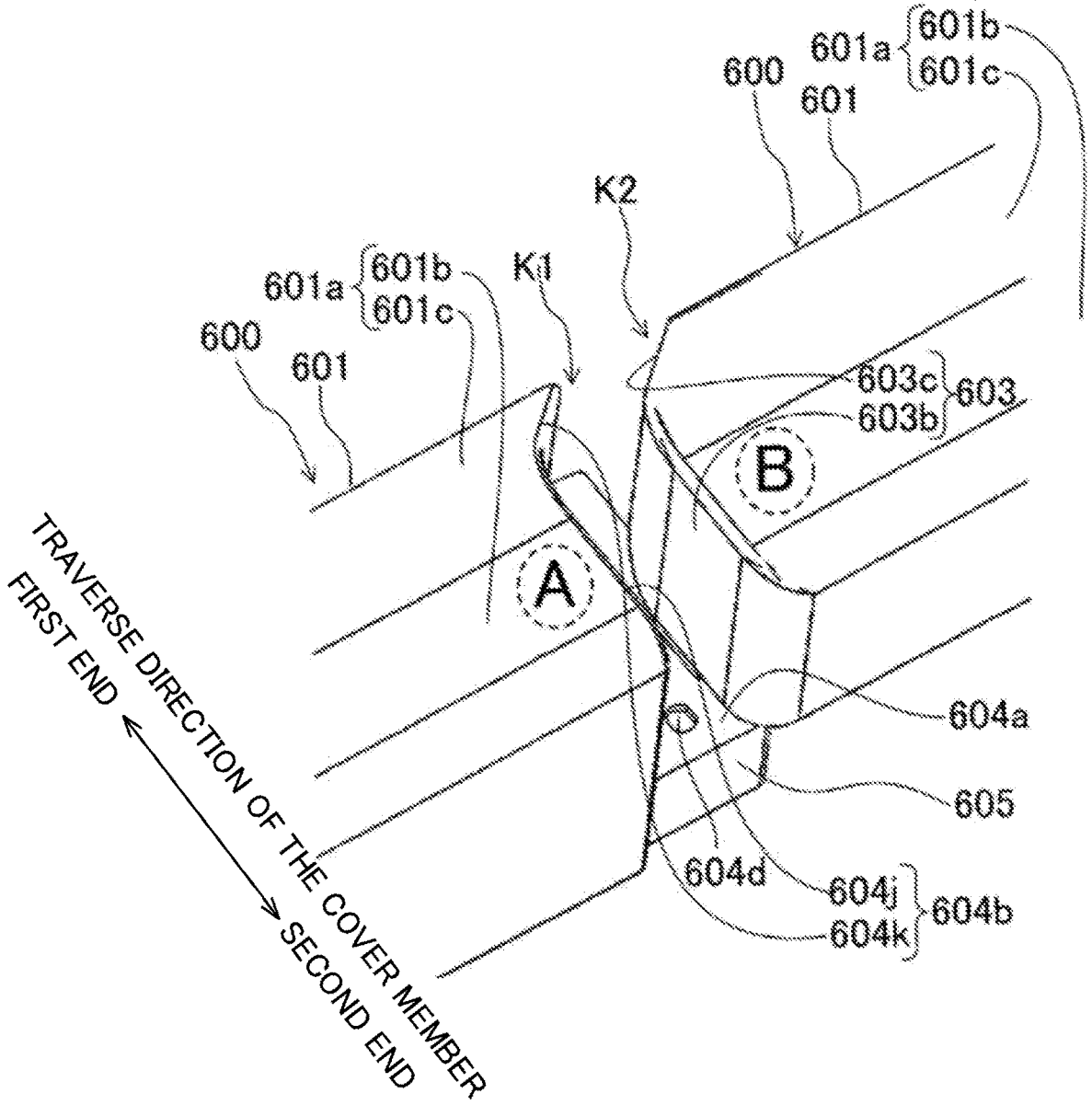
FIG. 17 is an enlarged perspective view of the first fitting portion at the first end part of one of the two cover members and the second fitting portion at the second end part of the other one of the two cover members.

FIGS. 16 and 17 show any two of the cover members 600; the side surface 604*b* of the first fitting portion K1 of one of the two cover members 600 and the end surface 603 of the second fitting portion K2 of the other one of the two cover members 600 are fitted to each other. The first fitting portion K1 and the second fitting portion K2 are thereby in the linear fitting state.

Figure 18:
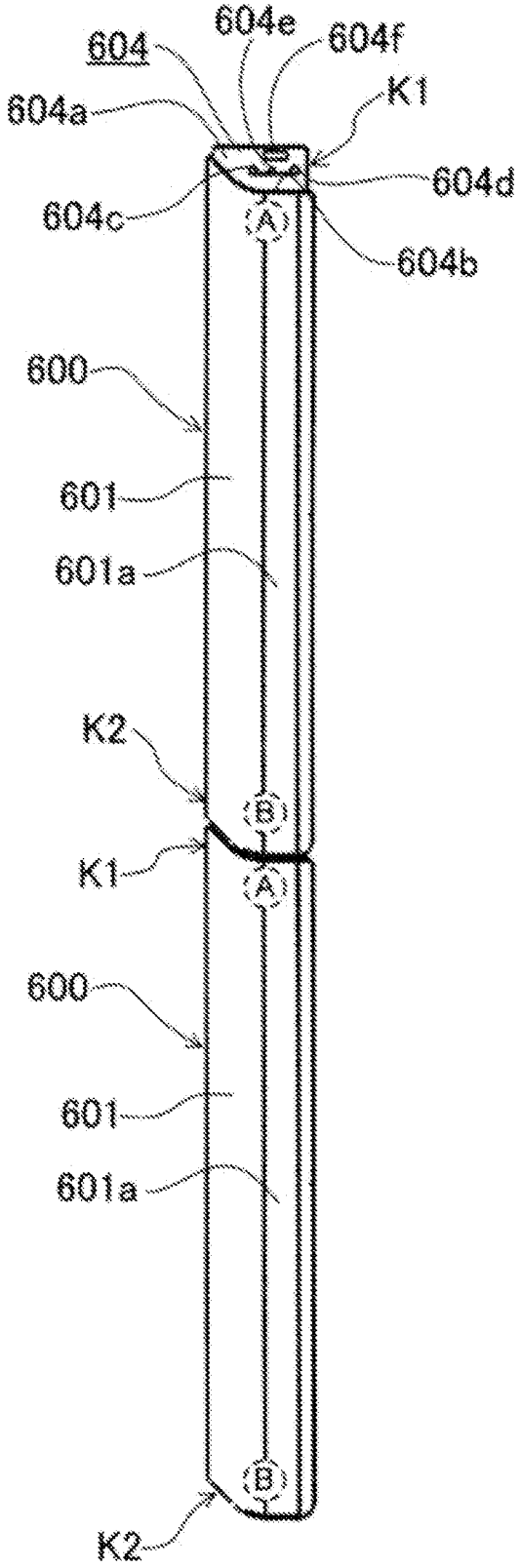
FIG. 18 is a plan view of the two cover members coupled in line with each other with the first and second fitting portion being in a linear fitting state, when viewed from the front side of the front-back direction.
Figure 19:
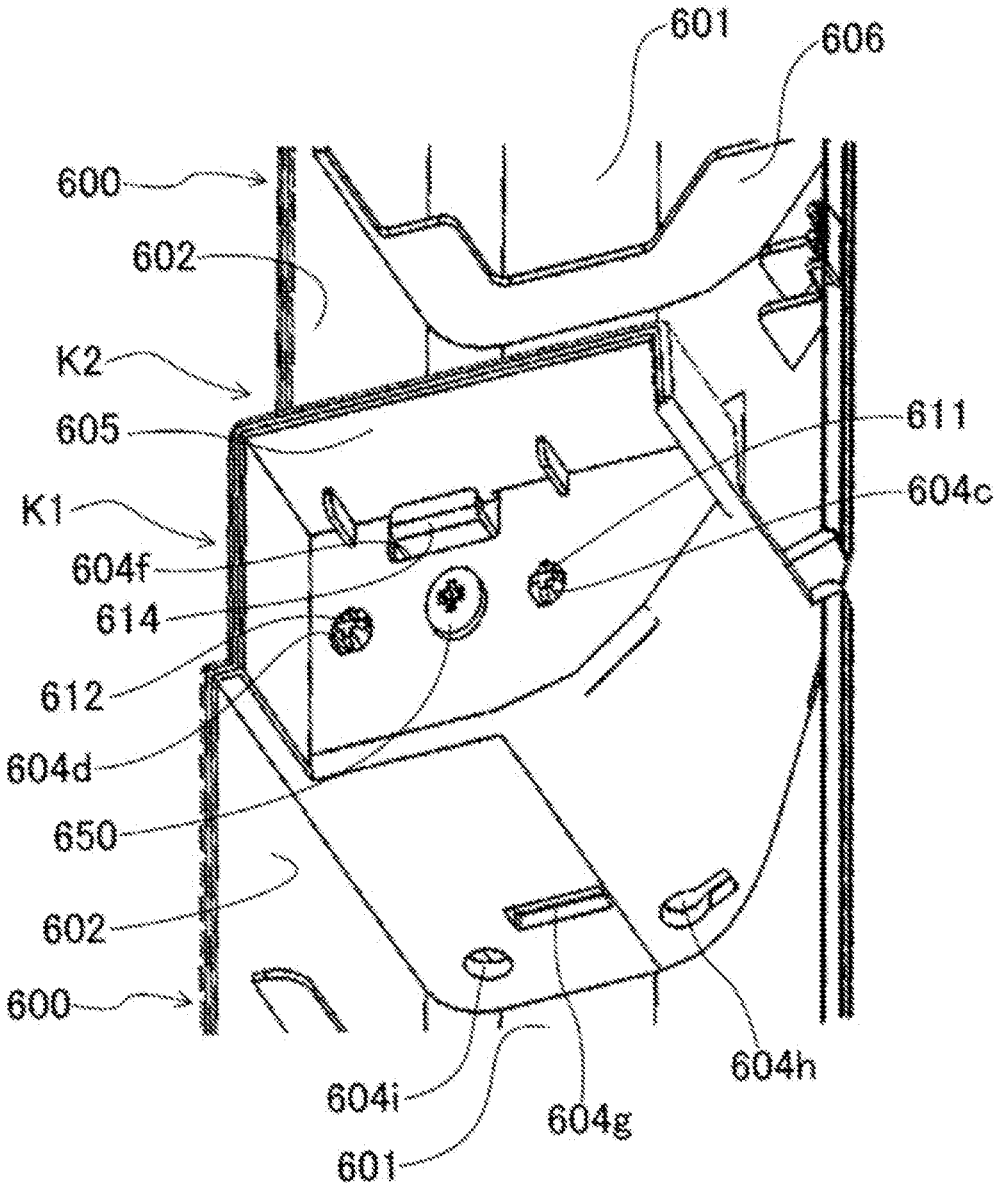
FIG. 19 is a perspective view of the first coupling and second fitting portion coupled with each other as illustrated in FIG. 18, when viewed from the back side of the front-back direction.

The two cover members 600 are thereby coupled in line with each other as illustrated in FIG. 18. In the linear fitting state, the positioning hole 604*c* of the first fitting portion K1 is engaged with the positioning projection 611 of the second fitting portion K2, and the positioning hole 604*d* of the first fitting portion K1 is engaged with the positioning projection 612 of the second fitting portion K2 as illustrated in FIG. 19. The two cover members 600 are thereby set in place to each other. When they are coupled in place in this manner, a screw 650 is inserted through the through hole 604*e* of the first fitting portion K1 and tightened into the tapped hole 613 of the second fitting portion K2 (see FIG. 11). The two cover members 600 are thereby fixed to each other such that they cannot be separated. In the linear fitting state, the latching hook 614 of the second fitting portion K2, which is used when they are coupled at a right angle, takes refuge in the idle hole 604*f* of the first fitting portion K1 with sufficient clearance.

[Description of the Right-angle Fitting State]

Figure 20:
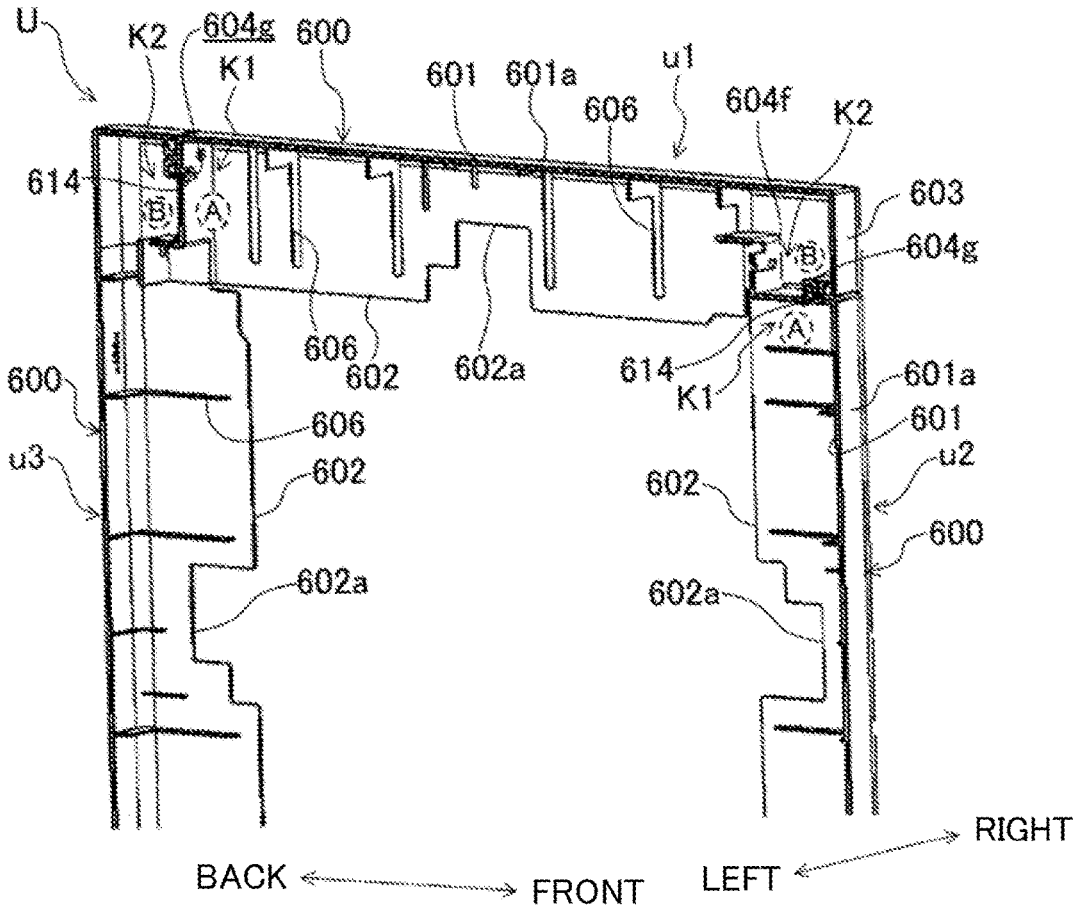
FIG. 20 is an enlarged section view of an upper half part of the external cover of the conveyance guide unit when cut widthwise in the middle.

Hereinafter, the right-angle fitting state of the first fitting portion K1 and the second fitting portion K2 will be described with reference to FIGS. 20 and 21. FIG. 20 illustrates the external cover U when cut widthwise in the middle. As Shown in the figure, the first fitting portion K1 and the second fitting portion K2 in the right-angle fitting state serve at upper-front and upper-back corners of the external cover U, for example.

Figure 21:
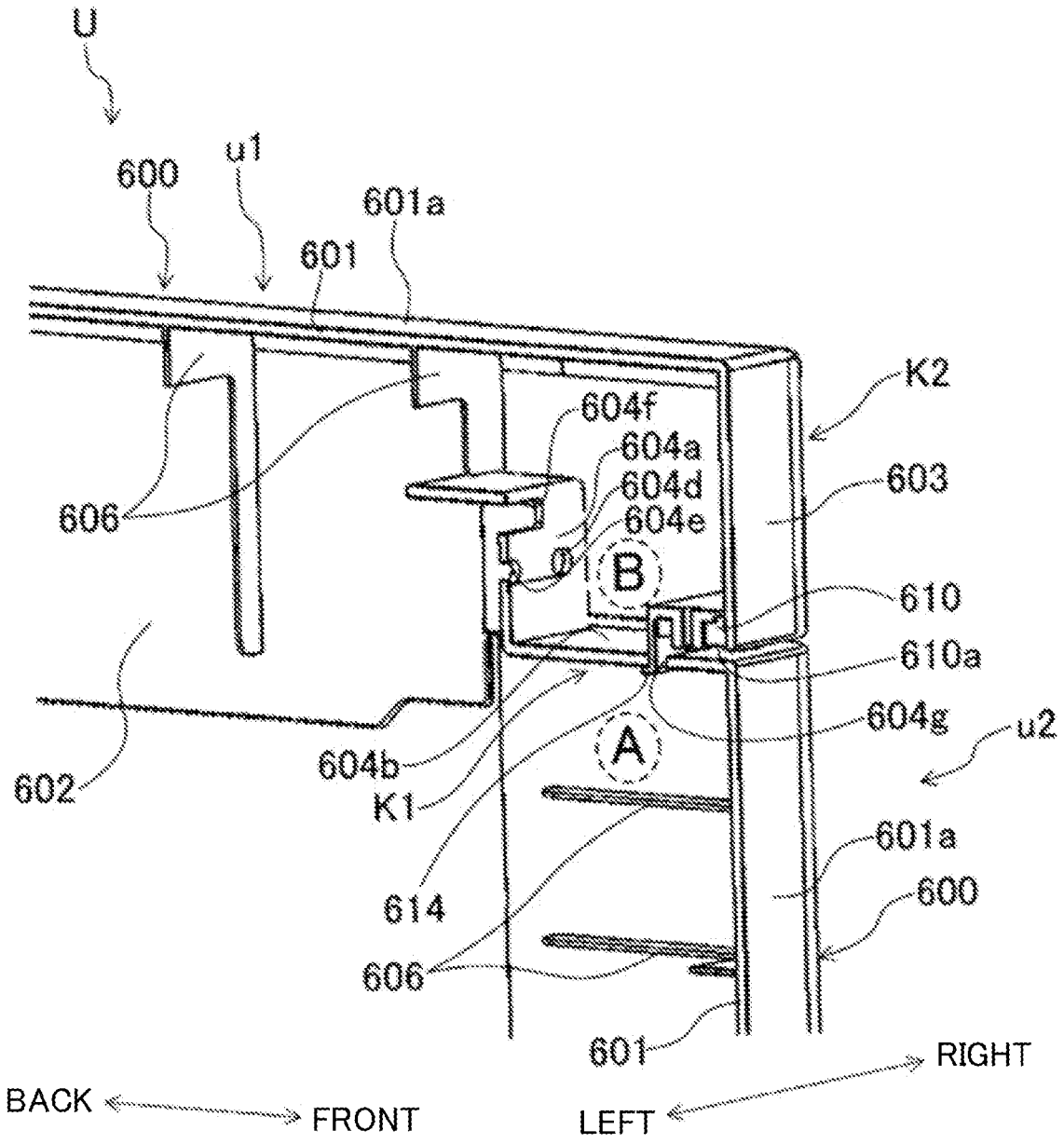
FIG. 21 is an enlarged view of an upper-front corner of the external cover of FIG. 20.

FIG. 21 is an enlarged view of an upper-front corner of the external cover U of FIG. 20. As shown in an example of the figure, in the right-angle fitting state, the side surface 604*b* of the first fitting portion K1 of the cover member 600 extending in an up-down direction is in contact with the contact surface 610*a* of the second fitting portion K2 of the cover member 600 extending in a right-left direction; and the two cover members 600 are thereby perpendicular to each other.

The latching hook 614 of the second fitting portion K2 is engaged with the latching hole 604*g* of the side surface 604*b* of the first fitting portion K1. Specifically, the hook part of the latching hook 604 is engaged with an edge part of the latching hole 604*g*, and the two cover members 600 are thereby fixed to each other at a right angle. The latching hole 604*g* is an example of a catch.

Furthermore, in the right-angle fitting state, although it is not shown, the positioning projection 611 shown in FIG. 11 is engaged with the positioning hole 604*h* shown in FIG. 15, and the positioning projection 612 shown in FIG. 11 is engaged with the positioning hole 604*i* shown in FIG. 15. The two cover members 600 are thereby set in place to each other. The positioning projections 611 and 612 project from the contact surface 610*a* of the second fitting portion K2. The positioning holes 604*h* and 604*i* are formed in the side surface 604*b* of the first fitting portion K1.

[Configuration of the External Cover U being Fixed in Place]

Referring to FIG. 4, the external cover U is fixed to the coupling mechanism 500 at three positions: a first fixing position F1, a second fixing position F2, and a third fixing position F3.

Figure 22:
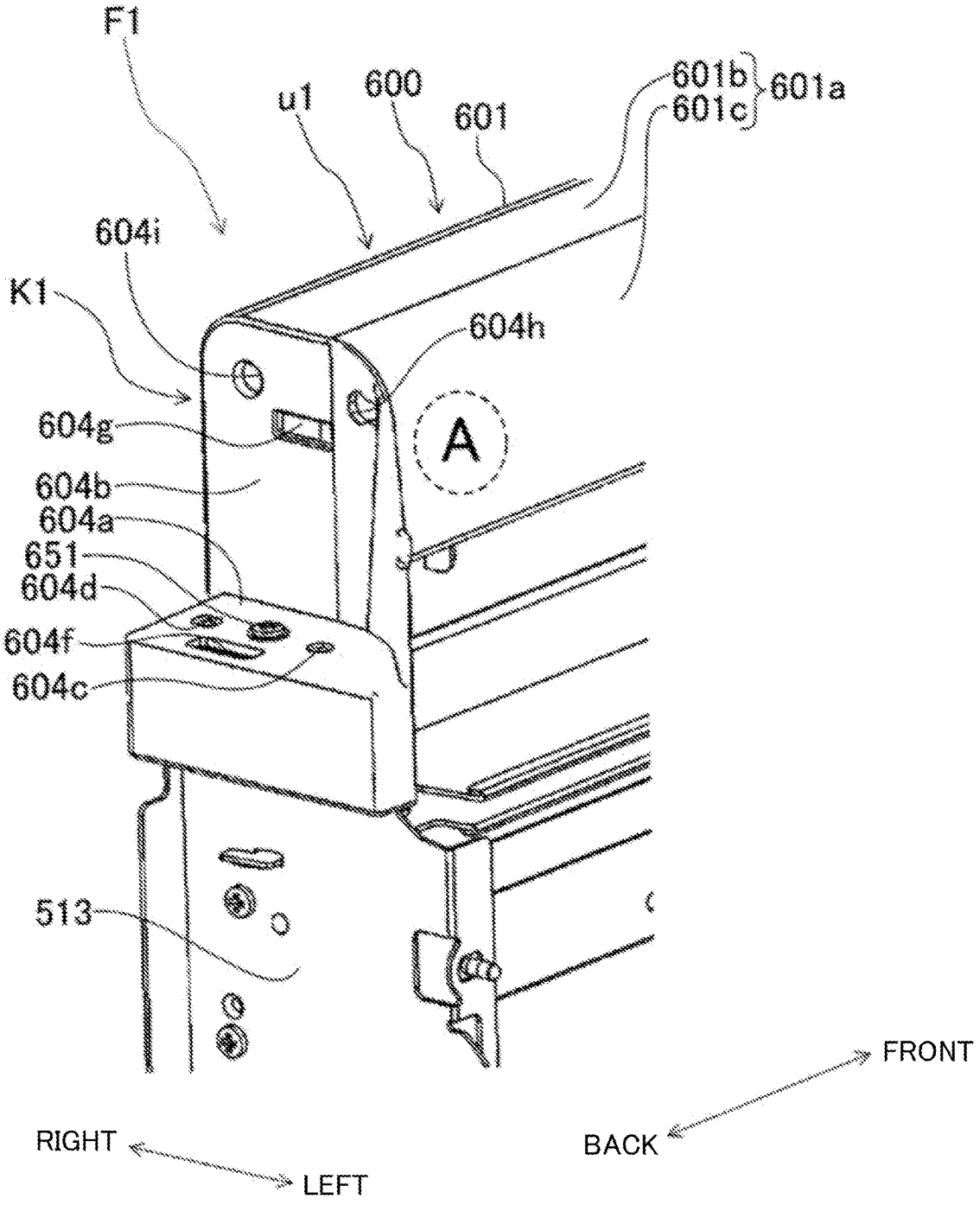
FIG. 22 is an enlarged perspective view of a first fixing position of the external cover of the conveyance guide unit.

FIG. 22 is an enlarged perspective view of the first fixing position F1. The first fixing position F1 is a position where a back end of the cover member 600 constituting the upper portion u1 of the external cover U is fixed to an upper end of the back vertical frame 513.

Specifically, a screw 651 is inserted through the through hole 604*e* formed in the base surface 604*a* of the first fitting portion K1. The base surface 604*a* of the first fitting portion K1 is in a back end part of the cover member 600. The screw 651 is further tightened into the tapped hole 513*e* of the bent plate part 513*d* shown in FIG. 5. The bent plate part 513*d* is at the upper end of the back vertical frame 513.

Figure 23:
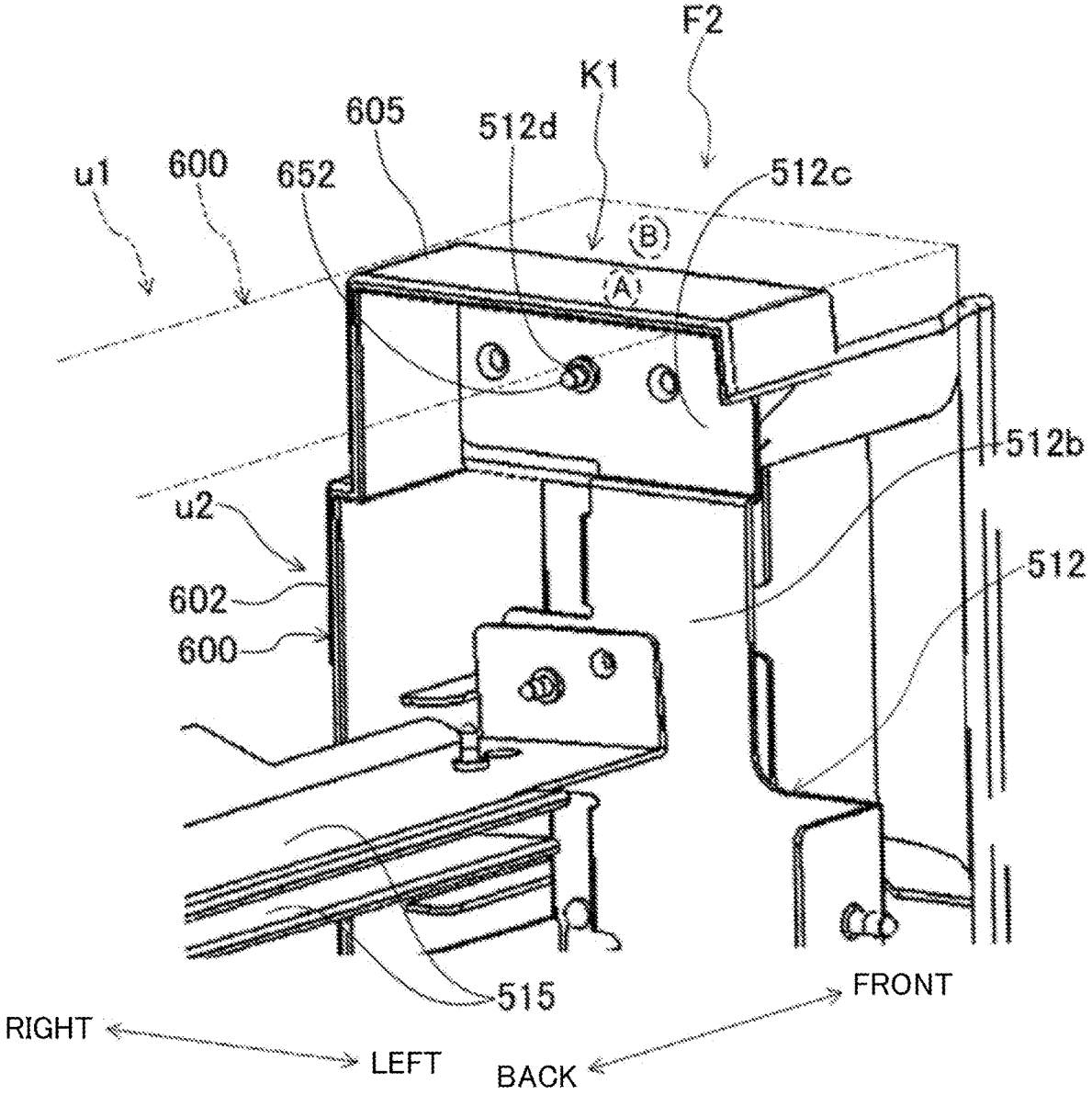
FIG. 23 is an enlarged perspective view of a second fixing position of the external cover the conveyance guide unit.

FIG. 23 is a perspective view of the second fixing position F2. The second fixing position F2 is a position where an upper end part of the upper cover member 600 constituting the front portion u2 of the external cover U is fixed to an upper end part of the front vertical frame 512.

Specifically, a screw 652 is inserted through the through hole 604*e* of the first fitting portion K1 that is at the upper end part of the upper cover member 600. The screw 652 is further tightened into the tapped hole 512*d* of the rectangular plate part 512*c* that is formed in the upper end part of the front vertical frame 512.

Figure 24:
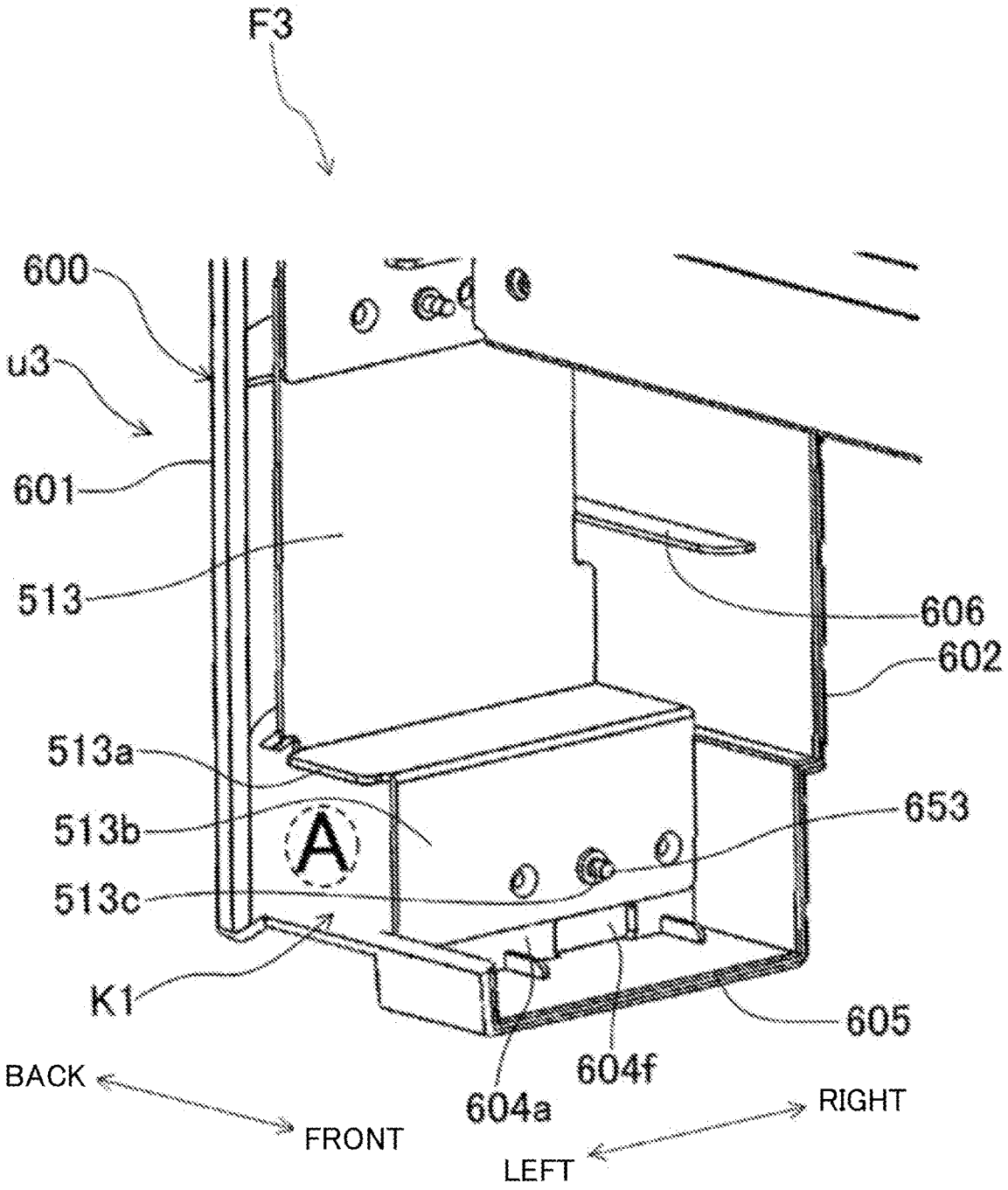
FIG. 24 is an enlarged perspective view of a third fixing position of the external cover of the conveyance guide unit.

FIG. 24 is a perspective view of the third fixing position F3. The third fixing position F3 is a position where a lower end part of the cover member 600 constituting the back portion u3 of the external cover U is fixed to a lower end part of the back vertical frame 513.

Specifically, a screw 653 is inserted through the through hole 604*e* of the first fitting portion K1 that is located at the lower end part of the cover member 600. The screw 653 is further tightened into the tapped hole 513*c* of the vertical plate part 513*b* that is formed in the lower end part of the back vertical frame 513 (see FIG. 5).

[Positions of the External Cover U in Relation to the Image Forming Apparatus 1 and the Post-Processing Device 400]

Figure 25:
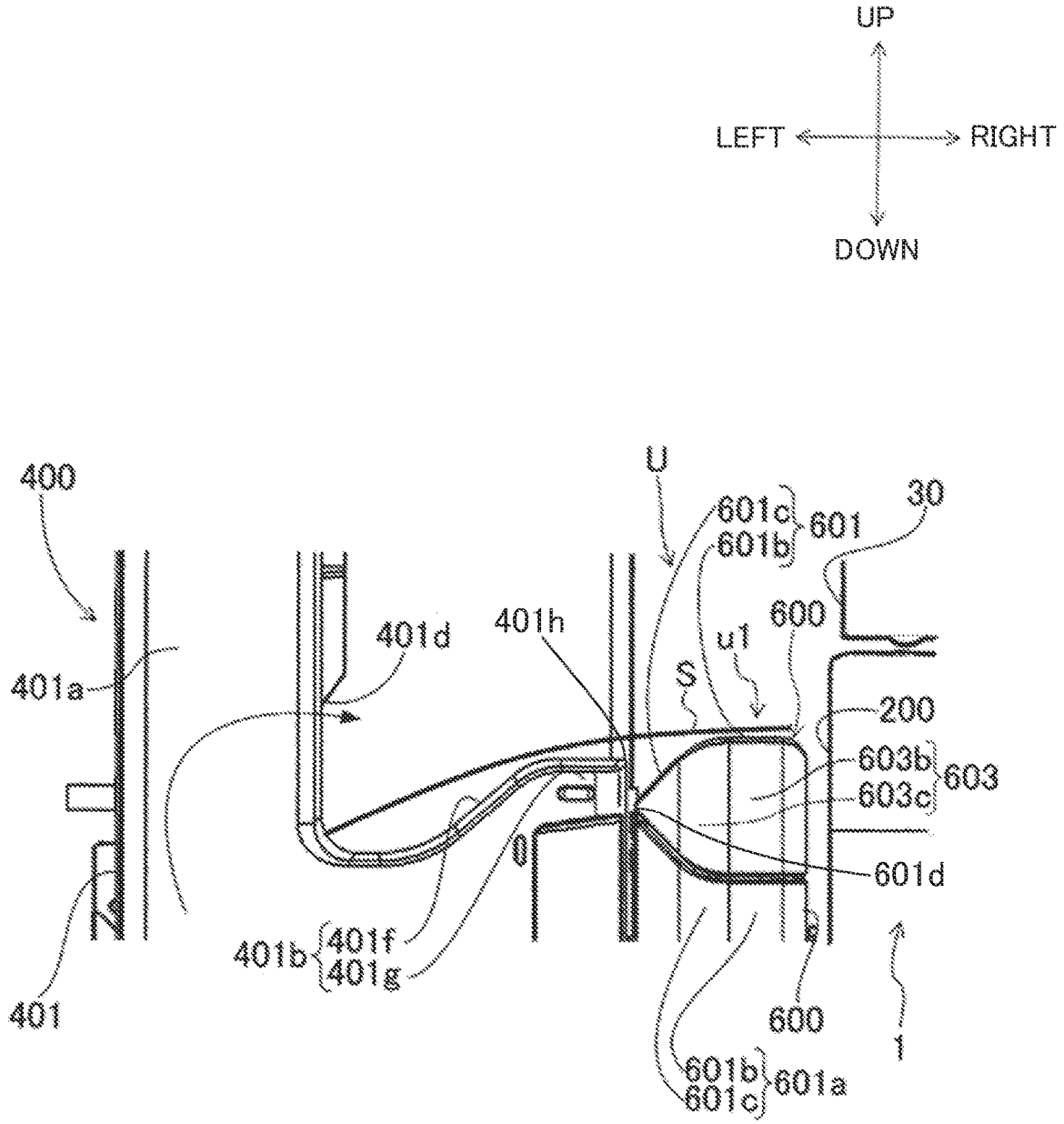
FIG. 25 is an enlarged plan view of a discharge tray part of the post-processing device and an upper end part of the external cover of the conveyance guide unit wen viewed from the front side.

The upper surface of the external cover U serves as an extension part of the discharge tray part 401*b* of the post-processing device 400 as illustrated in FIG. 25.

The discharge tray part 401*b* has an inclined surface 401*f* and a flat surface 401*g*. The inclined surface 401*f* is inclined upward from the left to the right. The flat surface 401*g* horizontally extends from an upper end edge of the inclined surface 401*f* to the right.

The upper surface of the external cover U includes the outer surface 601*a* of the cover member 600 constituting the upper portion u1. Specifically, the upper surface of the external cover U includes the inclined surface 601*c* and the flat surface 601*b*. The inclined surface 601*c* is inclined upward from the left to the right at an angle of 45 degrees approximately. A lower end edge of the inclined surface 601*c* is located lower than the flat surface 401*g* of the discharge tray part 401*b*, and an upper end edge of the inclined surface 601*c* is located higher than the flat surface 401*g* of the discharge tray part 401*b*.

In the example of FIG. 25, the flat surface 401*g* of the discharge tray part 401*b* is located in the middle of the vertical length of the inclined surface 601*c* of the cover member 600 constituting the upper portion u1. The inclined surface 601*c* of the cover member 600 guides the sheet S, which is discharged onto the discharge tray part 401*b*, such that the leading end of the sheet S keeps oriented upward to the right. The inclined surface 601*c* further guides the sheet S such that the leading end of the sheet S reaches the flat surface 601*b*.

Being discharged from the first discharge port 401*d*, the sheet S is smoothly delivered through the discharge tray part 401*b* to the upper surface of the external cover U without being interfered with the movement by the external cover U as illustrated in FIG. 25. The configuration should not be limited to the present embodiment in which there is a groove-like recession part between the discharge tray part 401*b* and the upper surface of the external cover U. The groove-like recession part is formed in an approximate shape of the letter V. Alternatively, the discharge tray part 401*b* and the upper surface of the external cover U may be aligned to be even with each other, for example. In other words, an upper surface edge part 601*d* of the external cover U may be aligned with an end part 401*h* of the discharge tray part 401*b* in a sheet discharge direction without a step. The upper surface edge part is an edge part of the upper surface of the external cover U, which is adjacent to the discharge tray part 401*b*.

Referring to FIG. 26, a horizontal width W of the external cover U is greater than an extending range Z extending to the left when the reclosable cover 35*a* is at a wide-open position. The relationship is expressed by W>Z. The extending range Z extending to the left is the range of the reclosable cover 35*a* extending from a left-side surface of the main body 100 toward the post-processing device 400. The left-side surface of the main body 100 is a surface of the main body 100, to which the protruding attachment member 520 is fixed.

Figure 27:
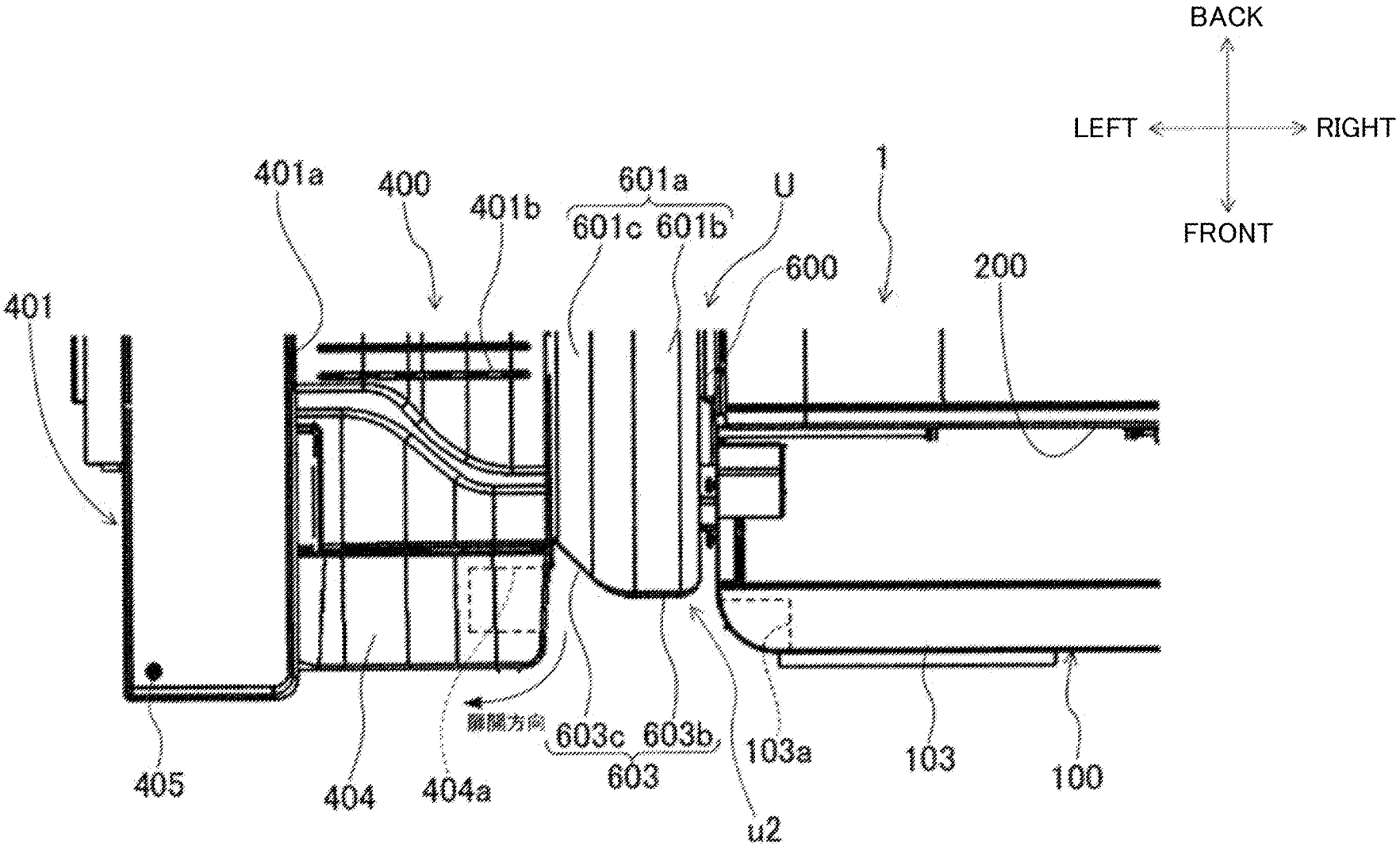
FIG. 27 is an enlarged plan view of front end parts of the post-processing device, the image forming apparatus, and the external cover of the conveyance guide unit.

Referring to FIG. 27, a reclosable door 404 is provided in a front region of the post-processing device 400. The reclosable door 404 is shaped in a rectangular case that is open toward the back in the closed state of the door. The reclosable door 404 has a recessed handle part 404*a*. The recessed handle part 404*a* is formed at an upper end part of a right end edge of the reclosable door 404 in the closed state.

A left end edge of the reclosable door 404 is supported by the cabinet 401 on an axis 405 extending in an up-down direction so that the reclosable door 404 can turn about the axis 405. For maintenance of the post-processing device 400, users can open the reclosable door 404 by turning the handle parts 404*a* about the axis 405 with the fingers frontward. An end edge part of the reclosable door 404, which is adjacent to the front portion u2 of the external cover U, includes an inclined surface that is inclined frontward as is closer to the image forming apparatus 1. The inclined surface is composed of: the inclined surface 603*c* of the end wall 603 of the cover member 600 constituting the upper portion u1 of the external cover U; and the inclined surface 601*c* of the outer surface 601*a* of the cover member 600 constituting the front portion u2 of the external cover U (see FIG. 25).

The cover member 600 constituting the front portion u2 of the external cover U is located toward the back of the handle part 103*a* of the front cover 103 of the main body 100 as illustrated in FIG. 27.

Figure 28:
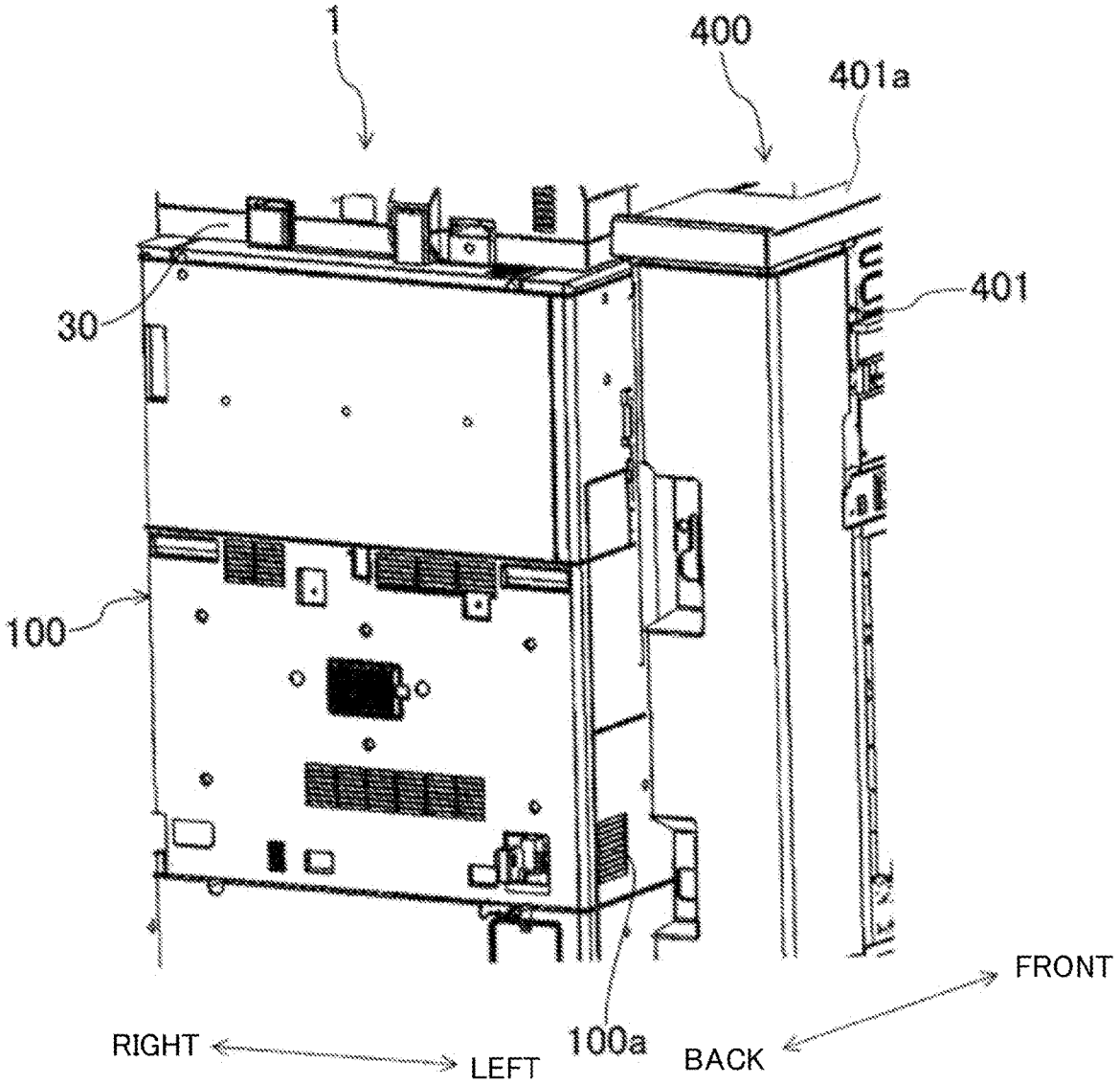
FIG. 28 is a perspective view of the post-processing device and the image forming apparatus when viewed from the left back side.
Figure 29:
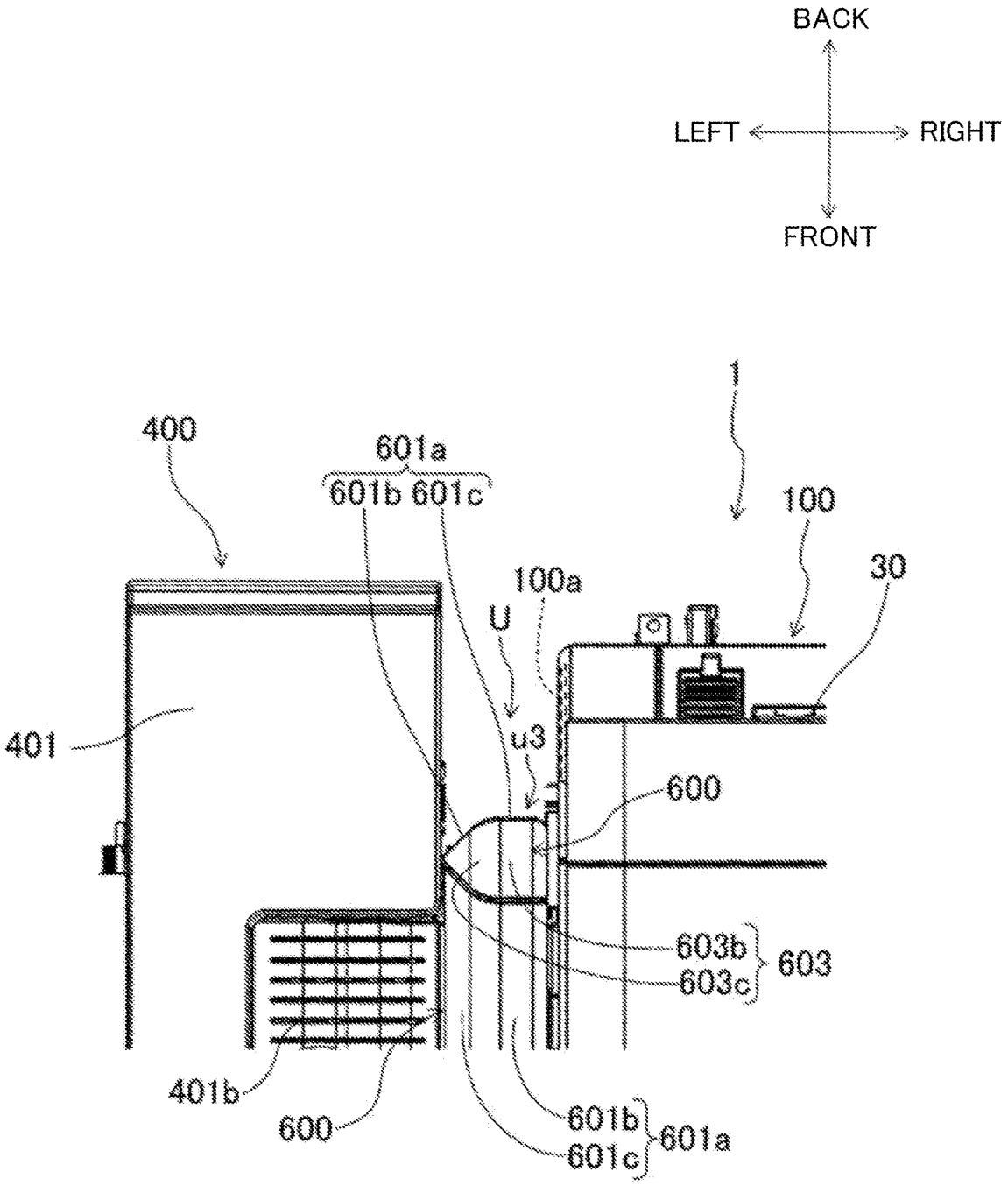
FIG. 29 is an enlarged plan view of back end parts of the post-processing device, the image forming apparatus, and the external cover of the conveyance guide unit.
Figure 30:
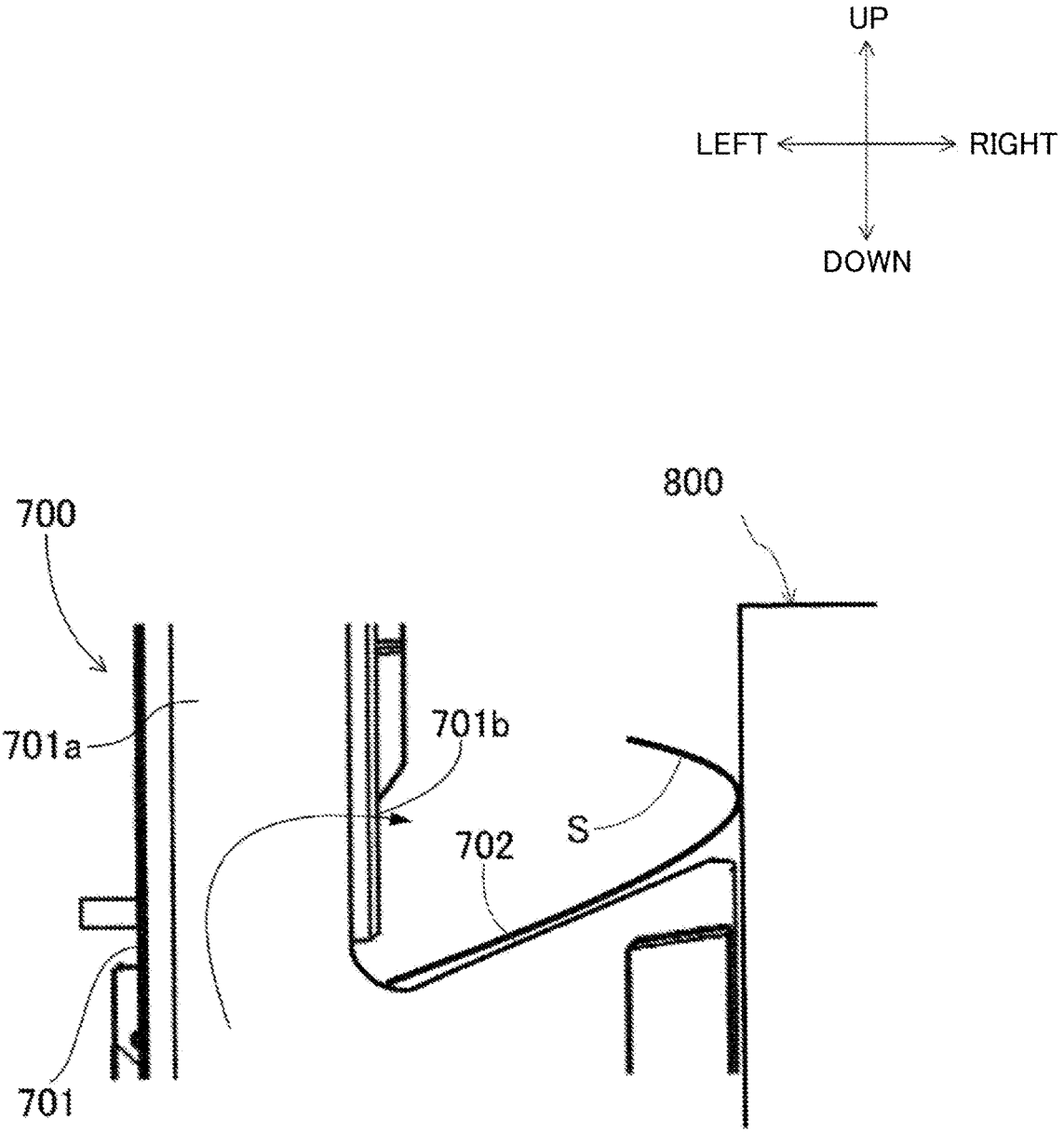
FIG. 30 is an enlarged plan view of the discharge tray part of the post-processing device and an upper end part of the image forming apparatus in a comparison example when viewed from the front side.

The image forming apparatus 1 has a rectangular breather 100*a* in a back end part of a left-side surface of the image forming apparatus 1 as illustrated in FIGS. 28 and 29. The breather 100*a* is a hole for air exhaust that allows cooling air, taken inside the main body 100 by a supply fan (not shown), go out through.

The cover member 600 constituting the back portion u3 of the external cover U is located toward the front of the breather 100*a* as illustrated in FIG. 29. The breather 100*a* should not be limited to a hole for air exhaust; it may be a hole for air intake alternatively.

[Effectiveness of the Present Embodiment]

As described above, in the present embodiment, the conveyance guide unit 900 is provided with a pair of the lead-in guide plates 515 that guides the sheet S, which is discharged from the sheet discharge port 302 of the relay conveyance device 300 installed in the image forming apparatus 1, to the sheet carrying-in port 401*c* of the post-processing device 400; the front vertical frame 512 and the back vertical frame 513 that support the pair of the lead-in guide plates 515; and the external cover U that is fixed to the front vertical frame 512 and the back vertical frame 513 and covers the upper part of the pair of the lead-in guide plates 515 and side parts of the pair of the lead-in guide plates 515 in traverse directions of the sheet conveyance path. The external cover U is configured such that the upper surface of the external cover U serves as an extension part of the discharge tray part 401*b* of the post-processing device 400, which is extended downstream, in a sheet discharge direction (see FIG. 25).

According to this configuration, the upper surface of the external cover U, which covers the conveyance guide unit 900, can be used as the discharge tray part 401*b*, successfully enhancing the capacity of stacking the sheets S by increasing a space for the sheets S to be stacked on, without the need for upsizing of the post-processing device 400. Furthermore, costs can be reduced by the use of the conveyance guide unit 900 in comparison with the use of a special extension tray.

Furthermore, in the present embodiment, the upper surface of the external cover U has an upper face edge part adjacent to the discharge tray part 401*b*, and the upper face edge part is inclined upward in a right-left direction (in a direction of facing), from the post-processing device 400 toward the image forming apparatus 1. In other words, the upper surface edge part of the external cover U is inclined upward from the post-processing apparatus 400 toward the image forming apparatus 1. In this case, the sheet S is not interfered with being discharged onto the discharge tray part 401*b* (see FIG. 25).

This configuration will prevent the sheet S from being interfered and turned by the external cover U when the sheet S is discharged onto discharge tray part 401*b*. In other words, this configuration will further enhance the capacity of stacking the sheets S.

Furthermore, in the present embodiment, a front end surface of the external cover U in the front-back direction is located toward the back of the handle part 103*a* of the front cover 103 of the image forming apparatus 1 (see FIG. 27). This configuration allows users to open and close the front cover 103 easily without being interfered by the external cover U.

Furthermore, in the present embodiment, a surface (left-side surface) of the image forming apparatus 1, which is a side surface adjacent to the post-processing device 400, has the breather 100*a*, and a back end surface of the external cover U in the front-back direction is located toward the front of the breather 100*a* (see FIG. 29).

This configuration will prevent the breather 100*a* from being blocked by the external cover U. In other words, this configuration will ensure a proper flow of air through the breather 100*a*.

Furthermore, in the present embodiment, the horizontal width W of the external cover U, which extends in a direction in which the image forming apparatus 1 and the post-processing device 400 face each other (see FIG. 26), is greater than the extending range Z, which extends to the left of the main body 100 when the reclosable cover 35*a* of the automatic document feeding device 30 is at the wide-open position.

This configuration keeps the space between the post-processing device 400 and the image forming apparatus 1 large enough for the reclosable cover 35*a* to be turned up to the wide-open position. This configuration allows users to open the front cover 103 easily for maintenance and removing jammed paper.

Furthermore, in the present embodiment, the front vertical frame 512 and the back vertical frame 513, which support the pair of the lead-in guide plates 515, further serve as frame members of the coupling mechanism 500 which attaches the post-processing device 400 to the image forming apparatus 1. Similarly, the external cover U further serves as a cover to cover the coupling mechanism 500. Costs can be reduced by commonality of these parts.

Another Embodiment

In the above-described embodiment, the relay conveyance device 300 is installed in the internal paper discharge space E of the image forming apparatus 1, and the conveyance guide unit 900 is configured to guide the sheet S from the relay conveyance device 300 to the post-processing device 400; the present disclosure, however, should not be limited to the above-described embodiment. For example, the conveyance guide unit 900 may be configured to guide the sheet S from a sheet discharge port of a rectangular image forming apparatus that does not have the internal paper discharge space E, to the post-processing device 400.

Furthermore, in the above-described embodiment, the external cover U is composed of a combination of the cover members 600; alternatively, the external cover U may be composed of one member.

In the above-described embodiment, the conveyance guide unit 900 is unified into the coupling mechanism 500; alternatively, the conveyance guide unit 900 may be separate from the coupling mechanism 500.

Although the image forming apparatus 1 is a copier in the above-described embodiment, it should not be limited thereto. Alternatively, the image forming apparatus 1 may be a printer, a facsimile, or a multifunctional peripheral (MFP), for example.

As described above, the present disclosure serves for a conveyance guide unit that guides sheets from an image forming apparatus to a post-processing device, especially when the image forming apparatus is a printer, a facsimile, a copier, or a multifunctional peripheral (MFP).

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A conveyance guide unit disposed in a space between an image forming apparatus configured to perform image forming on a sheet and a post-processing device attached to a side surface of the image forming apparatus in a detachable manner and configured to perform post-processing on the sheets subjected to image forming, the post-processing device comprising:

a cabinet containing a post-processing mechanism;

a sheet carrying-in port formed in a surface of the cabinet, the surface being adjacent to the image forming apparatus;

a discharge housing part that protrudes upward from a top surface of the cabinet and contains a sheet discharge mechanism;

a discharge tray part formed toward the image forming apparatus from the discharge housing part on the top surface of the cabinet; and a discharge port formed in a surface of the discharge housing part, the surface being adjacent to the image forming apparatus, wherein the post-processing device is configured to perform post-processing on the sheet coming through the sheet carrying-in port by the post-processing mechanism, then discharge the sheet through the discharge port toward the image forming apparatus by the sheet discharge mechanism, the conveyance guide unit comprising:

a guide member that guides the sheet to the sheet carrying-in port of the post-processing device, the sheet being discharged from a sheet discharge port of the image forming apparatus or from a sheet discharge port of a relay conveyance device installed on the image forming apparatus;

a supporting frame that supports the guide member; and an external cover fixed to the supporting frame and covering an upper part of the guide member and side parts of the guide member in a traverse direction of a sheet conveyance path, the traverse direction being perpendicular to a sheet conveyance direction, wherein the external cover has an upper surface serving as an extension part of the discharge tray part of the post-processing device, the extension part being extended downstream, in a sheet discharge direction.

2. The conveyance guide unit according to claim 1, wherein an upper portion of the external cover has an inclined surface inclined upward in a direction in which the image forming apparatus and the post-processing device face each other, from the post-processing device toward the image forming apparatus; or an edge part adjacent to the discharge tray part on an upper surface of the external cover is aligned with an end part of the discharge tray part in the sheet discharge direction without a step.

3. The conveyance guide unit according to claim 1, wherein the traverse direction of the sheet conveyance path is a front-back direction of the image forming apparatus, a front cover is attached to a front surface of the image forming apparatus in a detachable manner, a handle part is formed at an end edge part of the front cover, the end edge part being adjacent to the post-processing device, and a front end surface of the external cover in the front-back direction is located toward the back of the handle part of the front cover.

4. The conveyance guide unit according to claim 1, wherein the traverse direction of the sheet conveyance path is a front-back direction of the image forming apparatus, a breather for air exhaust or air intake is formed in the side surface of the image forming apparatus, the side surface facing the post-processing device, and a back end surface of the external cover in the front-back direction is located toward the front of the breather in the front-back direction.

5. The conveyance guide unit according to claim 1, wherein the traverse direction of the sheet conveyance path is a front-back direction of the image forming apparatus, a scanner housing portion is disposed in an upper end part of the image forming apparatus, the scanner housing portion containing an image reading portion and having a contact glass plate on a top of the scanner housing portion, an automatic document feeding device is disposed above the scanner housing portion, the automatic document feeding device being configured to convey a document through a top of the contact glass plate, the automatic document feeding device has: a casing containing a document conveyance mechanism; an opening part extending from a top wall surface to a side wall surface of the casing, the side wall surface being adjacent to the post-processing device; and a reclosable cover configured to open and close the opening part, an end edge part of the reclosable cover is supported by the casing on an axis extending in the front-back direction, the end edge part being adjacent to the post-processing device, and the reclosable cover is capable of turning about the axis and moving between a closed position at which the opening part is closed and a wide-open position at a predetermined angle upward from the close position, and when a width of the external cover is represented by W and a range of the external cover is represented by Z, a relationship between the width and the range is expressed by $W>Z$, the width extending in a direction in which the image forming apparatus and the post-processing device face each other, the range extending toward the post-processing device with respect to the side surface of the image forming apparatus when the reclosable cover is at the wide-open position.

6. The conveyance guide unit according to claim 1, wherein the supporting frame supporting the guide member further serves as a frame member of a coupling mechanism that attaches the post-processing device to the image forming apparatus.

7. The conveyance guide unit according to claim 6, wherein the external cover further serves as a cover to cover the coupling mechanism.

* * * * *